US011098884B2

(12) United States Patent
Machate

(10) Patent No.: US 11,098,884 B2
(45) Date of Patent: Aug. 24, 2021

(54) STRIP LIGHTING SYSTEM

(71) Applicant: ZUMTOBEL LIGHTING GMBH, Dornbirn (AT)

(72) Inventor: Andreas Machate, Wangen im Allgau (DE)

(73) Assignee: ZUMTOBEL LIGHTING GMBH, Dornbirn (AT)

( * ) Notice: Subject to any disclaimer, the term of this patent is extended or adjusted under 35 U.S.C. 154(b) by 0 days.

(21) Appl. No.: 16/959,729

(22) PCT Filed: Dec. 6, 2018

(86) PCT No.: PCT/EP2018/083733
§ 371 (c)(1),
(2) Date: Jul. 2, 2020

(87) PCT Pub. No.: WO2019/149410
PCT Pub. Date: Aug. 8, 2019

(65) Prior Publication Data

US 2020/0355356 A1 Nov. 12, 2020

(30) Foreign Application Priority Data

Jan. 31, 2018 (DE) ..... 20 2018 100 522.7

(51) Int. Cl.
*F21V 21/35* (2006.01)
*F21V 21/02* (2006.01)
(Continued)

(52) U.S. Cl.
CPC ..... *F21V 21/35* (2013.01); *F21S 9/00* (2013.01); *F21V 17/18* (2013.01); *F21V 21/025* (2013.01);
(Continued)

(58) Field of Classification Search
CPC ..... F21V 21/34; F21V 21/35; F21V 21/005; F21V 21/096; F21V 21/0965;
(Continued)

(56) References Cited

U.S. PATENT DOCUMENTS 4,475,226 A * 10/1984 Greenberg ..... F21V 33/0056 362/370
2006/0262521 A1* 11/2006 Piepgras ..... F21V 29/83 362/149
(Continued)

FOREIGN PATENT DOCUMENTS

DE 101 45 499 4/2003
DE 10 2011 017 702.7 10/2012
(Continued)

OTHER PUBLICATIONS

German search report dated Sep. 13, 2018 in priority German application 20 2018 100 522.7.
(Continued)

*Primary Examiner* — Jong-Suk (James) Lee
*Assistant Examiner* — James M Endo
(74) *Attorney, Agent, or Firm* — Andrus Intellectual Property Law

(57) ABSTRACT

Lighting strip system (1) which extends along a longitudinal axis direction (L) and has the following: an elongated carrier profile (2) with two elongated side walls (21, 22) that face each other and an elongated base wall (20) connecting the side walls (21, 22), which together delimit a receiving space (A), a first and a second mechanical coupling region (3, 4), wherein the first coupling region (3) is provided between the base wall (20) and the second coupling region (4) as viewed in the longitudinal axis direction (L), an elongated power supply unit (5) which extends in the longitudinal axis direction (L) in the receiving space (A), a lighting strip lamp
(Continued)

(6) which extends in the longitudinal axis direction (L), is electrically contacted with the power supply unit (5) and is releasably mechanically coupled to the second coupling region (4), and an electrical or electronic unit (7) with a functional region (73) and an operating region (74), wherein the functional region (73) is arranged adjacent to the lighting strip lamp (6) in the longitudinal axis direction (L), and wherein the operating region (74) extends starting from the functional region (73) at least partially between the lighting strip lamp (6) and the base wall (20), is electrically contacted with the power supply unit (5) and is releasably mechanically coupled to the first coupling region (3). Alternatively, the first coupling region (3) is provided on the side of one of the side walls (21) and the second coupling region (4) is provided on the side of the other of the side walls (22) as viewed in the longitudinal axis direction (L). In this case, the lighting strip lamp (6) and the unit (7) are both releasably mechanically coupled to the coupling regions (3, 4).

18 Claims, 20 Drawing Sheets

(51) Int. Cl.
*F21Y 103/10* (2016.01)
*F21Y 115/10* (2016.01)
*F21V 17/18* (2006.01)
*F21S 9/00* (2006.01)

(52) U.S. Cl.
CPC ..... *F21Y 2103/10* (2016.08); *F21Y 2115/10* (2016.08)

(58) Field of Classification Search
CPC .. F21V 21/025; F21V 21/0076; F21V 21/002; F21V 17/164; F21V 23/02; F21V 23/023; F21V 23/026; H01R 25/147; H01R 25/142; H01R 25/6205; H01R 25/145; H01R 25/161; H01R 25/162; H01R 25/14; H01R 25/164; H01R 25/165
See application file for complete search history.

(56) References Cited

U.S. PATENT DOCUMENTS

| | | | | |
|---|---|---|---|---|
| 2010/0271812 | A1* | 10/2010 | Harnischmacher | F21V 21/35 362/183 |
| 2014/0016503 | A1* | 1/2014 | Altekar | H01R 25/142 370/254 |
| 2014/0043802 | A1 | 2/2014 | Dings et al. | |
| 2014/0049954 | A1* | 2/2014 | Ladstaetter | F21S 4/20 362/221 |
| 2014/0347868 | A1* | 11/2014 | Jezsoviczki | F21V 29/73 362/373 |
| 2015/0226384 | A1* | 8/2015 | Park | F21V 21/34 362/223 |
| 2015/0292719 | A1* | 10/2015 | Park | F21S 8/026 362/221 |
| 2015/0316238 | A1* | 11/2015 | Guilmette | F21V 21/30 362/218 |
| 2016/0195250 | A1* | 7/2016 | Park | F21S 2/005 362/219 |
| 2017/0059135 | A1* | 3/2017 | Jones | F21V 17/002 |
| 2017/0130915 | A1* | 5/2017 | Xu | F21V 29/503 |
| 2017/0276332 | A1* | 9/2017 | Pearson | F21V 23/06 |
| 2017/0318649 | A1* | 11/2017 | Hall | F21S 8/043 |
| 2018/0202642 | A1 | 7/2018 | Weber | |

FOREIGN PATENT DOCUMENTS

| | | |
|---|---|---|
| DE | 20 2013 102 670.0 | 9/2014 |
| DE | 10 2013 216 275.8 | 3/2015 |
| EP | 2 650 607 | 10/2013 |
| EP | 3 217 067 | 9/2017 |
| WO | 2017/005943 | 1/2017 |

OTHER PUBLICATIONS

PCT search report dated Mar. 19, 2019 in parent PCT application PCT/EP2018/083733.

* cited by examiner

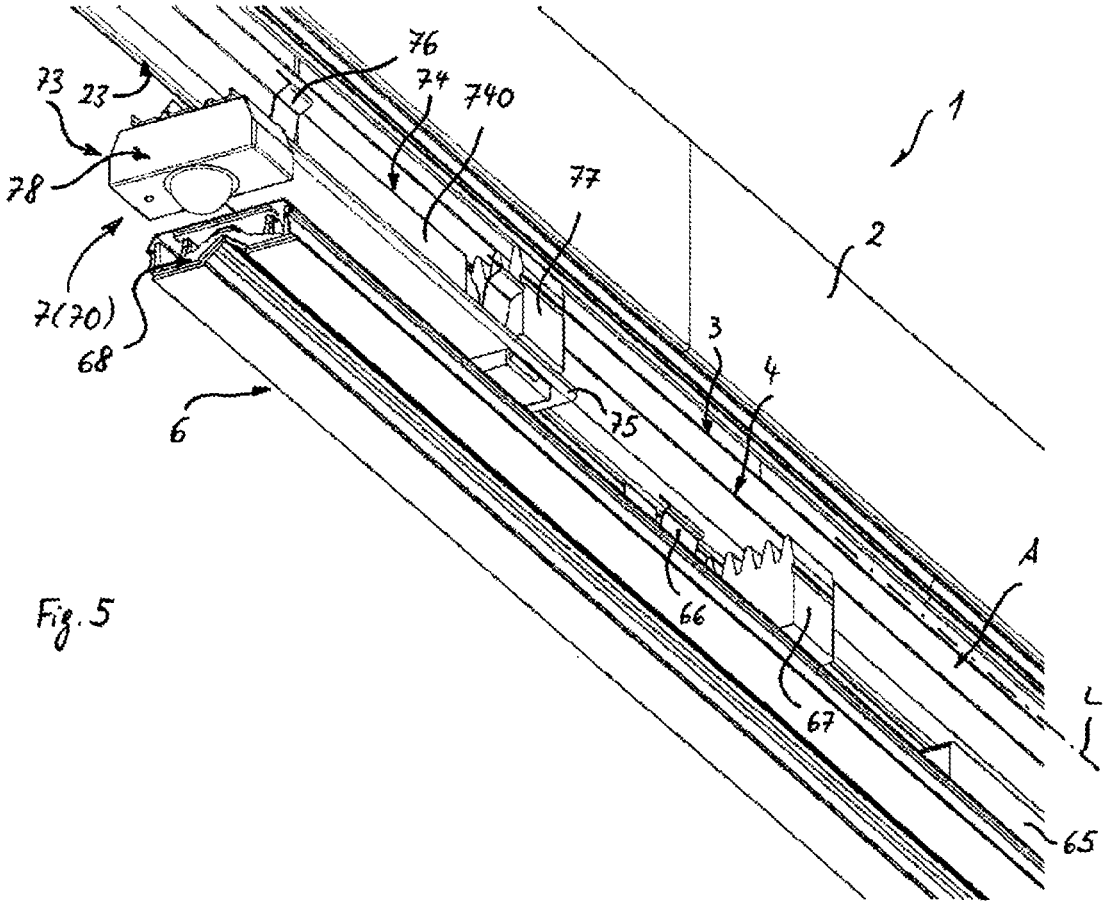
Fig. 5
Fig. 6
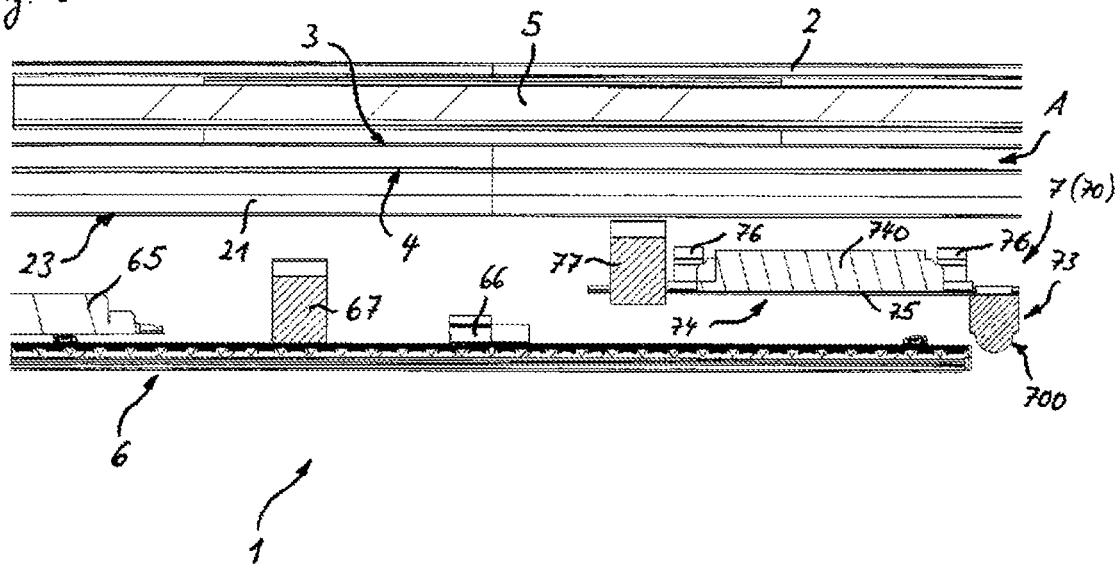

STRIP LIGHTING SYSTEM

CROSS REFERENCE TO RELATED APPLICATIONS

The present application is the U.S. national stage application of international application PCT/EP2018/083733 filed Dec. 6, 2018, which international application was published on Aug. 8, 2019 as International Publication WO 2019/149410 A1. The international application claims priority to German Patent Application 20 2018 100 522.7 filed Jan. 31, 2018.

FIELD OF THE INVENTION

The present invention relates to a lighting strip system which extends along a longitudinal axis direction and has an elongated carrier profile and a lighting strip lamp, power supply unit and electrical or electronic unit accommodated therein.

BACKGROUND OF THE INVENTION

Such lighting strip systems are known from the prior art. They generally have an elongated carrier profile with a U-shaped cross section. Generally, an elongated power supply unit is guided within this carrier profile. The open longitudinal side of the carrier profile is generally planar and covered flush with a lighting strip lamp and thus forms a closed and harmonious light line. Generally, in this case, the lighting strip lamp is electrically contacted with the power supply unit (for example supply lines or a busbar) by means of a current tap. This generally by simple radial insertion of the lighting strip lamp into the carrier profile. For mechanical coupling of the lighting strip lamp, the latter generally has latching elements which interact in a latching manner with corresponding profile elements of the carrier profile or a busbar in order to hold the radially inserted lighting strip lamp securely in the carrier profile.

Using these same latching profiles, other devices, such as speakers, sensors, spotlights, cameras, WLAN routers and the like, are often also fastened and connected to the carrier profile. For this purpose, the light line is interrupted over the entire length of the device used. The length of the devices to be connected is sometimes limited in this case not only by the functional components, such as a spotlight head or a sensor head, but in particular also by operating components necessary for the operation thereof, such as connection elements and operating devices.

SUMMARY OF THE INVENTION

It is thus an object of the present invention to provide a lighting strip system of the type mentioned at the outset which enables a harmonious and nearly continuous light line even in the presence of devices integrated into the lighting strip system.

In accordance with a first aspect, the present invention therefore relates to a lighting strip system which extends along a longitudinal axis direction. This lighting strip system has an elongated carrier profile with two elongated side walls that face each other and an elongated base wall connecting the side walls, which together delimit a receiving space. Furthermore, the lighting strip system has a first and a second mechanical coupling region, wherein the first coupling region is provided between the base wall and the second coupling region as viewed in the longitudinal axis direction. The lighting strip system furthermore has an elongated power supply unit which extends in the longitudinal axis direction in the receiving space. Furthermore, the lighting strip system has a lighting strip lamp which extends in the longitudinal axis direction, is electrically contacted with the power supply unit and is releasably mechanically coupled to the second coupling region. Finally, the lighting strip system has an electrical or electronic unit (hereinafter also referred to as a unit) with a functional region and an operating region. The functional region is arranged adjacent to the lighting strip lamp in the longitudinal axis direction. Starting from the functional region, the operating region extends at least partially between the lighting strip lamp and the base wall and is electrically contacted with the power supply unit and releasably mechanically coupled to the first coupling region.

In accordance with a second aspect, the present invention relates to a lighting strip system which extends along a longitudinal axis direction. This lighting strip system has an elongated carrier profile with two elongated side walls that face each other and an elongated base wall connecting the side walls, which together delimit a receiving space. Furthermore, the lighting strip system has a first and a second mechanical coupling region, wherein the first coupling region is provided on the side of one of the side walls and the second coupling region is provided on the side of the other of the side walls as viewed in the longitudinal axis direction. The lighting strip system furthermore has an elongated power supply unit which extends in the longitudinal axis direction in the receiving space. Furthermore, the lighting strip system has a lighting strip lamp which extends in the longitudinal axis direction, is electrically contacted with the power supply unit and is releasably mechanically coupled to the coupling regions. Lastly, the lighting strip system has an electrical or electronic unit with a functional region and an operating region, wherein the functional region is arranged adjacent to the lighting strip lamp in the longitudinal axis direction, and wherein the operating region extends starting from the functional region at least partially between the lighting strip lamp and the base wall, is electrically contacted with the power supply unit and is releasably mechanically coupled to the coupling regions.

By means of the lighting strip system according to the invention, the region of an outwardly exposed electrical or electronic unit which is visible from the outside, i.e. which interrupts the light line, can be minimized, in that, from the unit which is provided separately in the functional and operating region, only the functional region of this unit is positioned there, while the further structure of this unit which is combined in the operating region extends at the back of the lighting strip lamp in a region of the receiving space not taken up by the latter. In order to enable the unit to also be fastened in a secure and unimpeded manner with respect to the lighting strip lamp, an additional mechanical coupling region is provided for the unit, which coupling region is provided precisely between the base wall and the coupling region of the lighting strip lamp as viewed in the longitudinal axis direction, or opposite coupling regions are provided on the side walls for both components. Thus, on the one hand, the installation space of the lighting strip system can be used more effectively, while at the same time the effect of a continuous light line, which is generally to be achieved with a lighting strip system, is impaired as little as possible. Due to the relative arrangement of the coupling regions, the unit extending partially behind the lighting strip lamp in the installed state can also be installed first or at the edge of an already installed lighting strip lamp part and does not impede the subsequent installation of the or additional lighting strip lamp(s) which partially covers the unit.

The first and/or the second coupling region preferably extends in the longitudinal axis direction in the receiving space and particularly preferably over the entire length of the carrier profile. Thus, both the lighting strip lamp and the electrical or electronic unit can be provided at any desired positions in the longitudinal axis direction of the lighting strip system.

The first and/or the second mechanical coupling region is preferably provided on at least one and particularly preferably both side walls or on the power supply unit. In this case, an integral design with precisely this is particularly preferably conceivable. An integral design with the side walls can be achieved, for example, by profiling of the carrier profile; for example provided by corresponding bending of a carrier profile provided from sheet metal or profile production by extrusion methods. A profile element provided by the power supply unit, as is the case, for example, with a busbar, can, for example, also be used as a coupling region for mechanical coupling. In general, the first and/or the second coupling region can be formed by profile regions, such as a latching profile, of the side walls or power supply unit, or recesses, such as punches, in the side walls or in the power supply unit. Thus, the coupling regions can be provided particularly simply.

The lighting strip lamp can have a second coupling element, corresponding to the second coupling region and preferably also to the first coupling region, for mechanically coupling to the second coupling region and preferably also to the first coupling region. Similarly, the electrical or electronic unit can have a first coupling element, corresponding to the first coupling region and preferably also to the second coupling region, for mechanically coupling to the first coupling region and preferably also to the second coupling region. By providing a corresponding coupling element, an element designed in a defined manner for achieving effective coupling can be provided in a simple manner. In particular, with such coupling elements, the corresponding components (lighting strip lamp, electrical or electronic unit) are to be held (radially) in the carrier profile so that they do not fall out and are at best fixed. It is conceivable that the coupling regions in conjunction with the respective coupling elements preferably permit/allow a sliding movement of the lighting strip lamp or of the electrical or electronic unit along the longitudinal axis direction. In a preferred embodiment, the first and/or the second coupling element can have, for example, a latching springs, pretensioned laterally to the respective coupling regions, with a first latching section, preferably a V-shaped latching section projecting outward. In this case, the first latching section interacts in a latching manner with a corresponding second latching section of the respective coupling regions in order to provide the mechanical coupling. An effective (radial) mechanical coupling can be achieved by providing a latching spring. A latching spring can be easily manufactured and connected to the lighting strip lamp on the one hand or the electrical or electronic unit on the other hand. The preferred embodiment of such a latching spring with a V-shaped latching section described above also enables the simple insertion, retention and also subsequent removal of the corresponding component since the V shape forms, at correspondingly provided angles of the two legs of the V shape, a defined inclined insertion surface of the latching section, which can then interact with the corresponding coupling region for preferably simple insertion and removal. In the best case, the V shape also enables sliding in the longitudinal axis direction. The first and second coupling elements can be identically designed as identical parts.

The lighting strip lamp preferably extends between the two side walls and particularly preferably completely between the two side walls. This preferably results in a closed light emission surface of the lighting strip lamp and thus an optimally uninterrupted light line of the lighting strip system. The lighting strip lamp preferably delimits the carrier profile on the side opposite the base wall and preferably covers it in order to thus be able to provide a shape and light line which is outwardly even and closed.

The functional region of the electrical or electronic unit preferably also extends between the two side walls and particularly preferably completely between the two side walls. This, in particular in interaction with a lighting strip lamp which likewise extends completely between the side walls, enables an overall appearance which is as interruption-free or play-free as possible. In addition to the optical effects, due to the provision of the lighting strip system that is as free of play as possible, the latter is also better protected against outside influences, such as dust. For this purpose, the functional region particularly preferably lies flush in the longitudinal axis direction and particularly preferably gap-free against the lighting strip lamp, in order to thus particularly preferably delimit or cover the carrier profile on the side opposite the base wall without gaps.

The power supply unit is preferably provided between the base wall and the first coupling region and more preferably on the base wall. In such a form, the power supply unit is preferably provided in the form of a continuously tappable busbar. Other possibilities are also conceivable, for example supply lines, such as a feed-through wiring, for example with prefabricated tapping sockets, or also systems with insulation-displacement contacts. However, it is also conceivable that the power supply unit is alternatively or additionally provided on at least one or both side walls. In such an embodiment, the power supply unit could be provided, for example, as a busbar for rotary tapping, for example with a rotary body described below. In such a form, the lines lie in profile grooves of a separate profile element or of the side walls, which grooves extend along the longitudinal axis direction and are laterally open toward the receiving space. By inserting a corresponding current tap (for example by means of the rotary body described below) with laterally projecting tap arms or latching projections, the latter can be driven into the profile grooves by rotation, engage there and thus be electrically contacted with the lines laid therein in order to provide a secure and simple current tap. A mechanical coupling can also be achieved in a comparable manner.

The lighting strip lamp can have a first electrical contacting element and the electrical or electronic unit, preferably the operating region, can have a second electrical contacting element. In a particularly preferred embodiment, the aforementioned electrical contacting elements can be constructed identically. In this way, the number of different components of the lighting strip system can be reduced by using as many identical parts as possible. The first electrical contacting element can extend in a first extension direction in a region between the lighting strip lamp and the base wall and preferably project from the lighting strip lamp into the receiving space as far as the power supply unit. The second electrical contacting element can extend in a second extension direction, which is preferably parallel to the first extension direction, in a region between the lighting strip lamp and the base wall and preferably extend in a protruding manner on both sides of the operating region with respect to this extension direction. The operating region is provided further offset into the receiving space with respect to the lighting strip lamp and is thus generally arranged closer to the power supply unit. If one wants to use identical parts for the contacting elements, the second electrical contacting element must pass through the operating region or a unit carrier of the unit or of the operating region, due to the smaller distance of the operating region from the power supply unit, and thus protrudes on both sides of the operating region. Preferably, however, the second electrical contacting element projects at least from the operating region into the receiving space as far as the power supply unit. Thus, overall, consideration is given to the arrangement of the lighting strip lamp offset in the insertion direction on the one hand and to the electrical or electronic unit on the other hand.

The lighting strip lamp and/or the electrical or electronic unit can have a rotary body which is rotatably provided about a rotational axis and has laterally protruding latching projections. The latching projections can be movable by rotation of the rotary body about its rotational axis between a retracted mounting position for inserting the lighting strip lamp or electrical or electronic unit into the carrier profile and an extended position for interacting with the coupling regions for mechanical coupling and/or the power supply unit for electrical coupling. For this purpose, the latching projections can preferably have the coupling elements and/or the electrical contacting elements. Such a rotary body can then be provided as a rotary tap or rotary toggle, in which preferably both the mechanical and the electrical coupling elements are integrated.

The lighting strip lamp and/or the electrical or electronic unit can each have at least two rotary bodies, wherein at least one of the rotary bodies has no latching projections for electrical coupling, wherein the mechanical coupling preferably permits a sliding movement of the lighting strip lamp or of the electrical or electronic unit along the longitudinal axis direction.

The rotary body can have a rotary manipulator for rotating the rotary body about its rotational axis, wherein the rotary manipulator preferably extends radially on one or more sides, preferably on two sides, away from the rotational axis, is further preferably arranged centrally or coaxially or symmetrically or asymmetrically as viewed with respect to the rotational axis. For example, a (laterally mounted) lever-like mechanism or a (centrally provided) wing screw-like mechanism are conceivable. In a preferred embodiment, it is conceivable for the rotary manipulator to be axially displaceable or movable relative to the rotary body or together with the rotary body relative to the rest of the component carrying it (lighting strip lamp, unit) in the direction of the rotational axis. The rotary manipulator should thus preferably be movable between an operating position, in which it is rotatable about the rotational axis in order to move the rotary projections between the retracted mounting position and the extended position, and an installation position, in which it is not rotatable about the rotational axis (in particular with the latching projections in the extended position, in order to reliably maintain the electrical/mechanical coupling). In a particularly preferred embodiment, the rotary manipulator protrudes in the operating position from the rest of the component carrying it (preferably counter to its insertion direction into the carrier profile), in order to position it to be easily accessible and operable for the operator from the outside. In the installation position, the rotary manipulator then protrudes less far relative to the rest of the components carrying it, or is even provided in a recessed or flush manner so that in the assembled/connected state of the lighting strip lamp or unit, the latter are provided particularly compactly and the lamp can thus be made more compact overall or the already limited installation space in the carrier profile between the overlapping components can be utilized more effectively.

The carrier profile preferably has an essentially U-shaped cross-section as viewed in the longitudinal axis direction. The base wall and the two side walls of the carrier profile preferably form an essentially U-shaped cross-section as viewed in the longitudinal axis direction. This essentially corresponds to a common structure of a carrier profile for a lighting strip system.

The open side of the carrier profile opposite the base wall preferably forms a light emission side of the lighting strip system via which the lighting strip lamp and the electrical or electronic unit can be inserted into the carrier profile for mechanical coupling with the respective coupling regions. In spite of different coupling planes or coupling sides, simple assembly is thus enabled.

On its side facing the receiving space, the lighting strip lamp can have electronic components, such as an operating device. These are preferably spaced apart from the opposite end faces of the lighting strip lamp in the longitudinal axis direction and are particularly preferably provided in the center of the lighting strip lamp. In this way, a free space is created in the receiving space in end regions of the lighting strip lamp, which free space can be at least partially occupied by the operating region of the electrical or electronic unit for a compact design of the lighting strip system. In order to securely support this free end of the lighting strip lamp, the lighting strip lamp can preferably have, in the region between at least one of the end faces and electronic component, the second coupling element in the form of latching springs, which form a comparatively compact latching structure and thus ensure a secure mechanical coupling even in a small space.

The functional region can be provided with respect to the longitudinal axis direction in a region of one of the end faces of the operating region opposite in the longitudinal axis direction or spaced apart from these two end faces. In the first variant, it can be enabled to install the components lighting strip lamp, unit and again lighting strip lamp successively in that the unit is placed with its functional region, from which the operating region extends away from the lighting strip lamp, next to a lighting strip lamp or a part of the lighting strip lamp. The lighting strip lamp connecting thereto or the next part thereof can then be easily inserted in front of the operating region so that the functional region is arranged between the lamp and the base wall. In the second variant, the operating region overlaps with both adjacent parts of the lighting strip lamp. In this respect, the operating region either has to be pushed behind an already installed part of the lighting strip lamp before the next part is provided on the other side as viewed in the longitudinal axis direction. Or the unit is first installed and then the adjacent parts of the lighting strip lamp are placed in front of it. Due to the smaller overlap of the operating region with the respective parts of the lighting strip lamp, a free end thereof can be made shorter in the second variant, and additional mechanical holding components in this region can thus be dispensed with. The first variant has the advantage that the components are successively and simply installed in the given sequence as viewed in the longitudinal axis direction.

The electrical or electronic unit can be designed in the form of any conceivable unit. Examples which are mentioned here by way of example are lamps, such as spotlights or emergency lights, sensors, such as PIR sensors, AC/DC converters, camera modules, such as security camera modules, WLAN modules, scanners, projectors, laser projectors, monitoring electronics, data transmission systems, plug adapters for connecting electrical or electronic components and the like. The functional region can have functional components of the electrical or electronic unit. Lamp or spotlight heads, for example including spotlight shaft, sensor heads, connection sockets, such as USB-C sockets, WLAN antennas and the like are mentioned purely by way of example. The operating region can also have operating components of the electrical or electronic unit. Operating devices, light control, sensor processing units and the like are mentioned here purely by way of example. The lighting strip system thus offers innumerable possibilities for the integration of electrical or electronic units according to the invention.

As already mentioned, the lighting strip lamp is preferably designed in several parts in the longitudinal axis direction in order to provide any desired lighting strip length. At least some adjacent parts of the lighting strip lamp can adjoin one another flush and preferably gap-free in the longitudinal axis direction. At least between two parts of the lighting strip lamp, a functional region of an electrical or electronic unit can be correspondingly arranged, as described above. The carrier profile can also be designed in several parts in the longitudinal axis direction.

The lighting strip lamp can have lamp components. In particular, lighting means, such as LED modules for light emission, and preferably further optical units for influencing the light emitted by the lighting means are mentioned here. The lighting strip lamp can further have a lighting strip carrier which carries the lamp components and preferably also the second coupling element and/or the first contacting element.

The lighting strip lamp is preferably designed to be essentially planar on its outer side facing away from the receiving space and particularly preferably terminates essentially flush with the side of the carrier profile opposite the base wall. In a comparable manner, the functional region can be designed to be essentially planar on its side facing away from the receiving space and preferably terminates essentially flush with the side of the carrier profile opposite the base wall and further preferably with the planar outer side of the lighting strip lamp. In this way, an overall harmonious appearance can be provided in the most interruption-free and gap-free manner possible.

The first mechanical coupling region and/or the second mechanical coupling region can each have a plurality of coupling regions in planes differently spaced apart with respect to the base wall. The same applies in the same way to electrical coupling section of the power supply unit. In this way, it is fundamentally possible to couple a plurality of lighting strip system components, in particular a plurality of units, mechanically or electrically in the receiving space, wherein the respective components can all at least partially overlap due to the different coupling planes so that an overall particularly compact design of the lighting strip system is provided with the most interruption-free and play-free appearance possible. Mechanical or electrical coupling planes can also be provided for differently designed contacting elements or coupling elements, which increases the flexibility of the system.

BRIEF DESCRIPTION OF THE DRAWINGS

Further embodiments and advantages of the present invention are described hereinafter with reference to the figures of the accompanying drawings. The following are shown:

FIG. 5 is an exploded perspective view of the lighting strip system in accordance with FIG. 1, FIG. 6 is a lateral cross-sectional view of the lighting strip system in accordance with FIG. 5.

DETAILED DESCRIPTION

Figure 1:
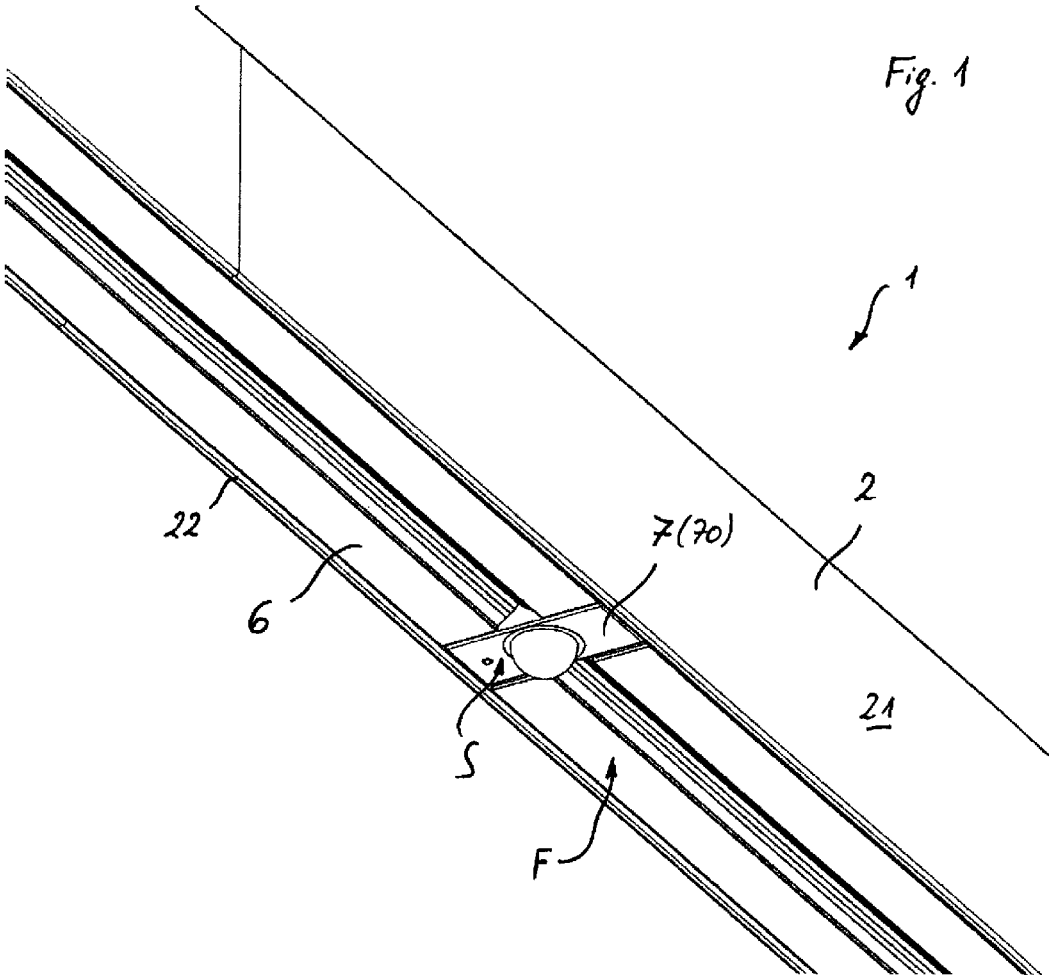
FIG. 1 is a perspective view of a lighting strip system according to a first exemplary embodiment of the present invention.
Figure 2:
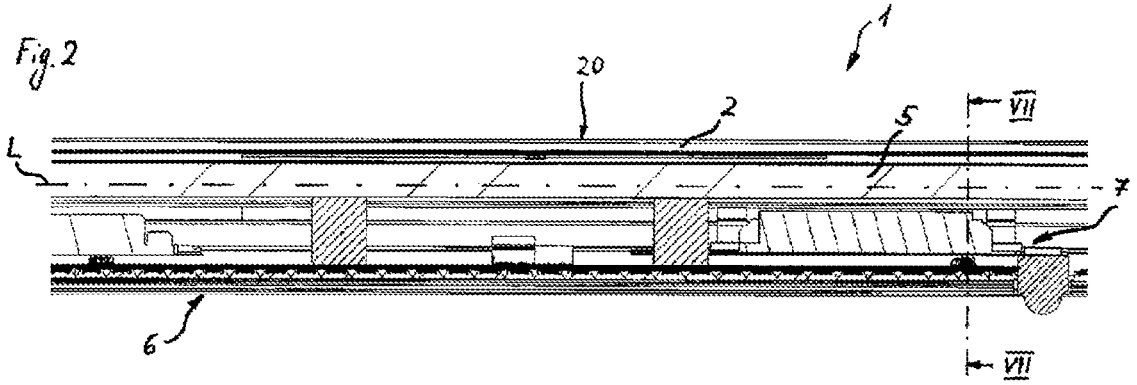
FIG. 2 is a lateral cross-sectional view of the lighting strip system in accordance with FIG. 1.
Figure 4:
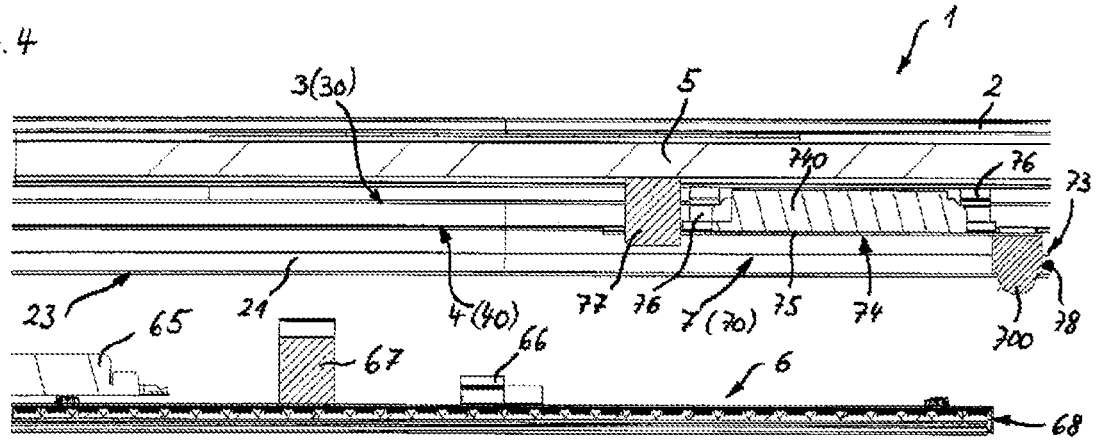
FIG. 4 is a lateral cross-sectional view of the lighting strip system in accordance with FIG. 3.
Figure 3:
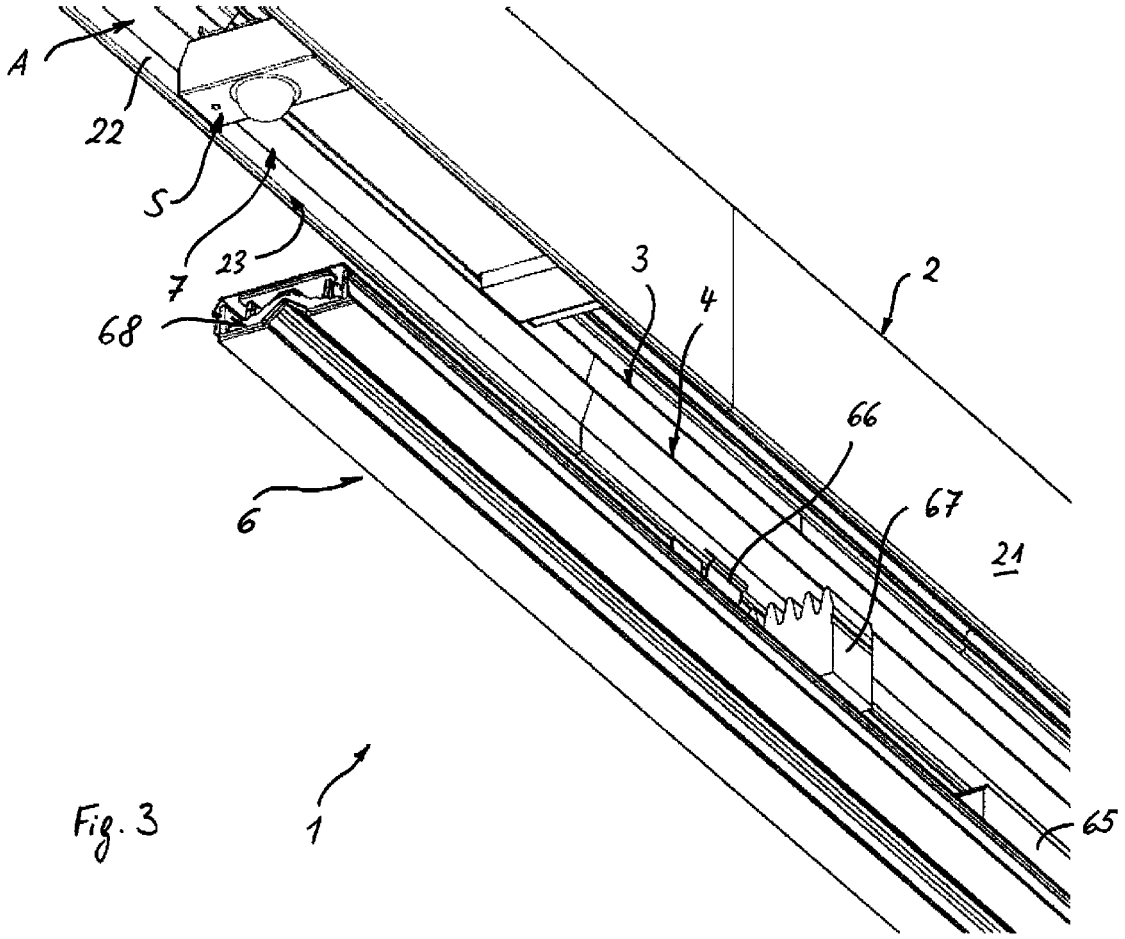
FIG. 3 is a detailed view of a partial exploded view of the lighting strip system in accordance with FIG. 1.
Figure 7:
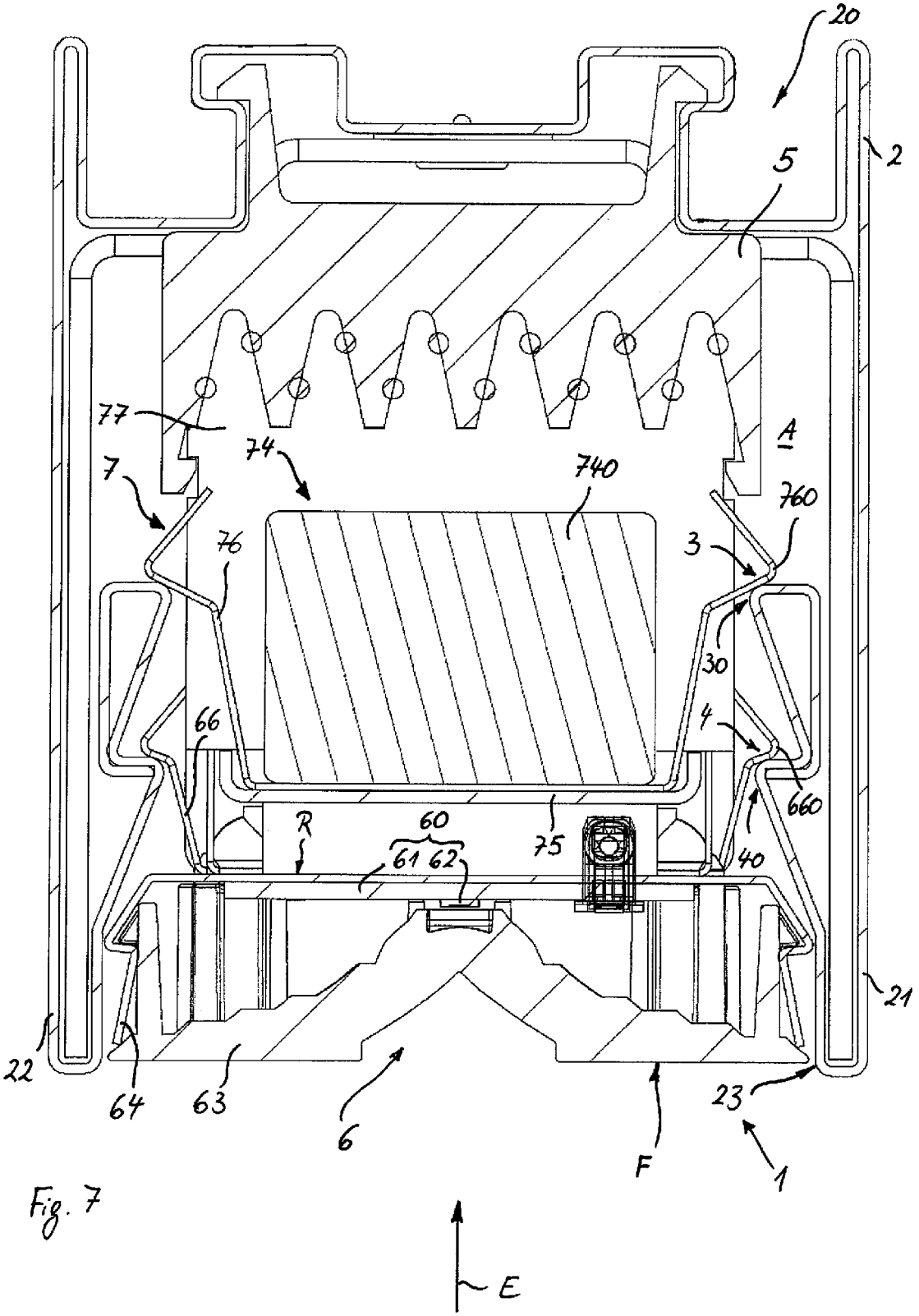
FIG. 7 is a cross-sectional view taken along the line VII-VII in accordance with FIG. 2.
Figure 20:
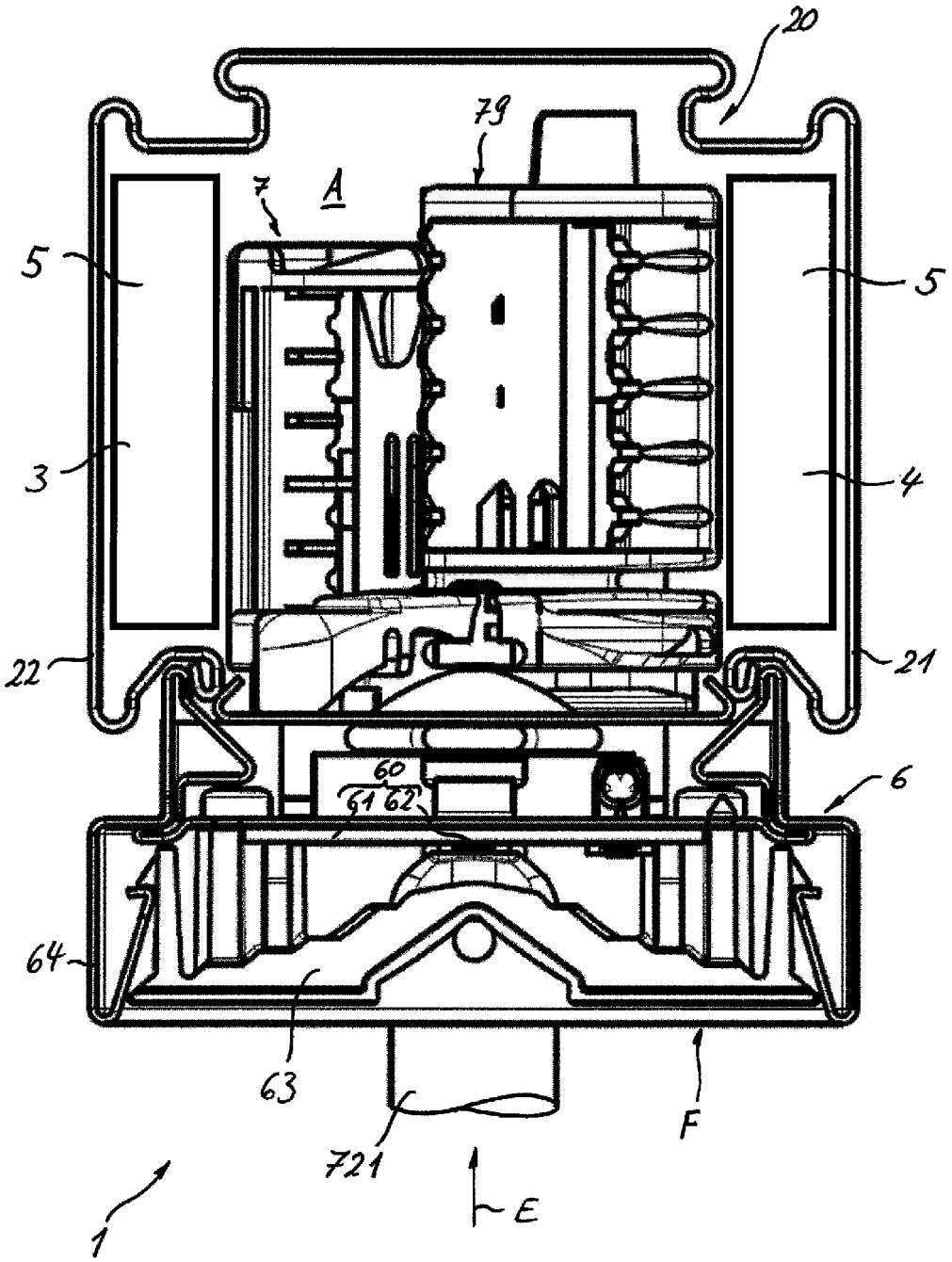
FIG. 20 is a lateral cross-sectional view of the lighting strip system in accordance with FIG. 18*c*.
Figure 21:
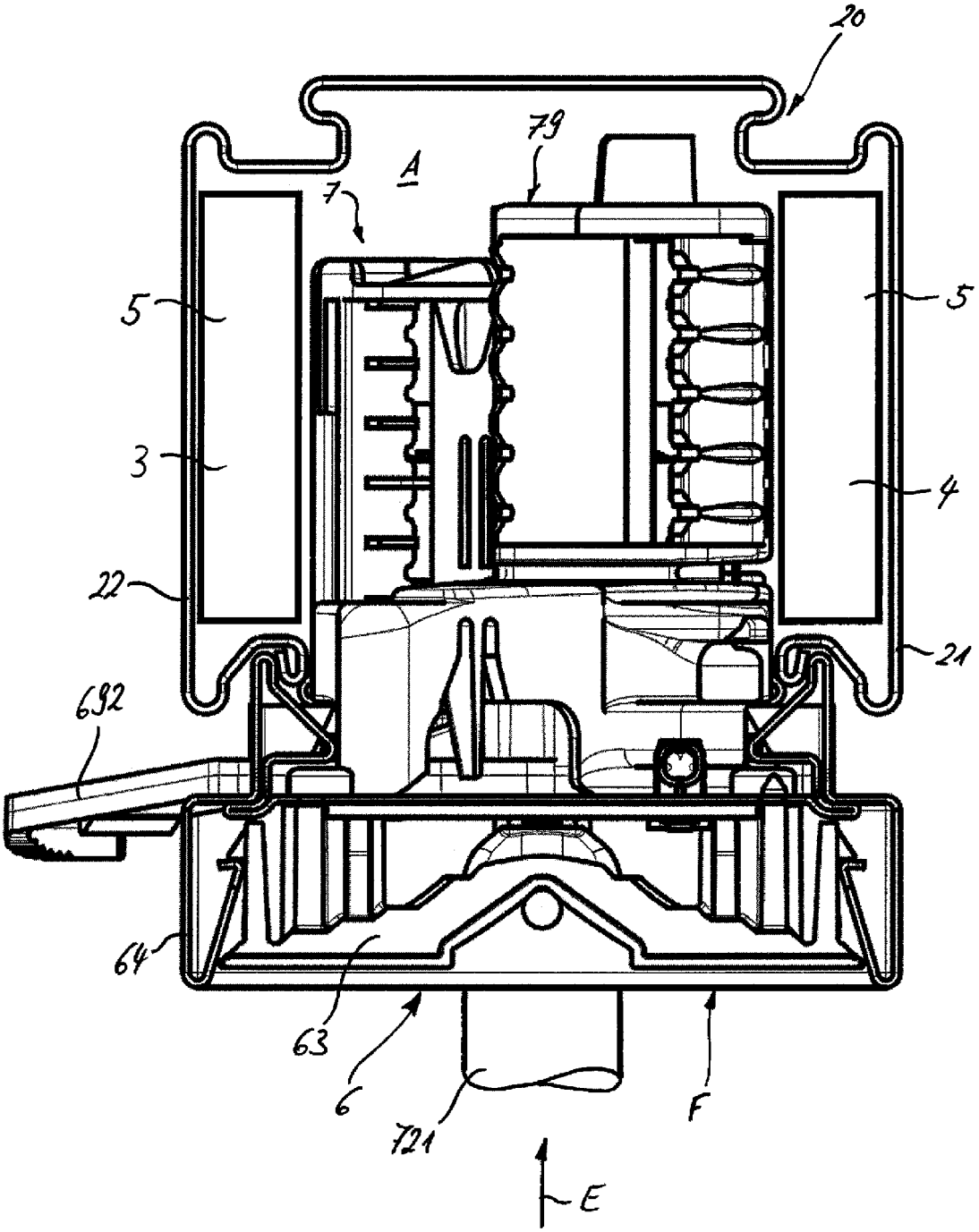
FIG. 21 is a further lateral cross-sectional view of the lighting strip system in accordance with FIG. 18*c*.
Figure 22:
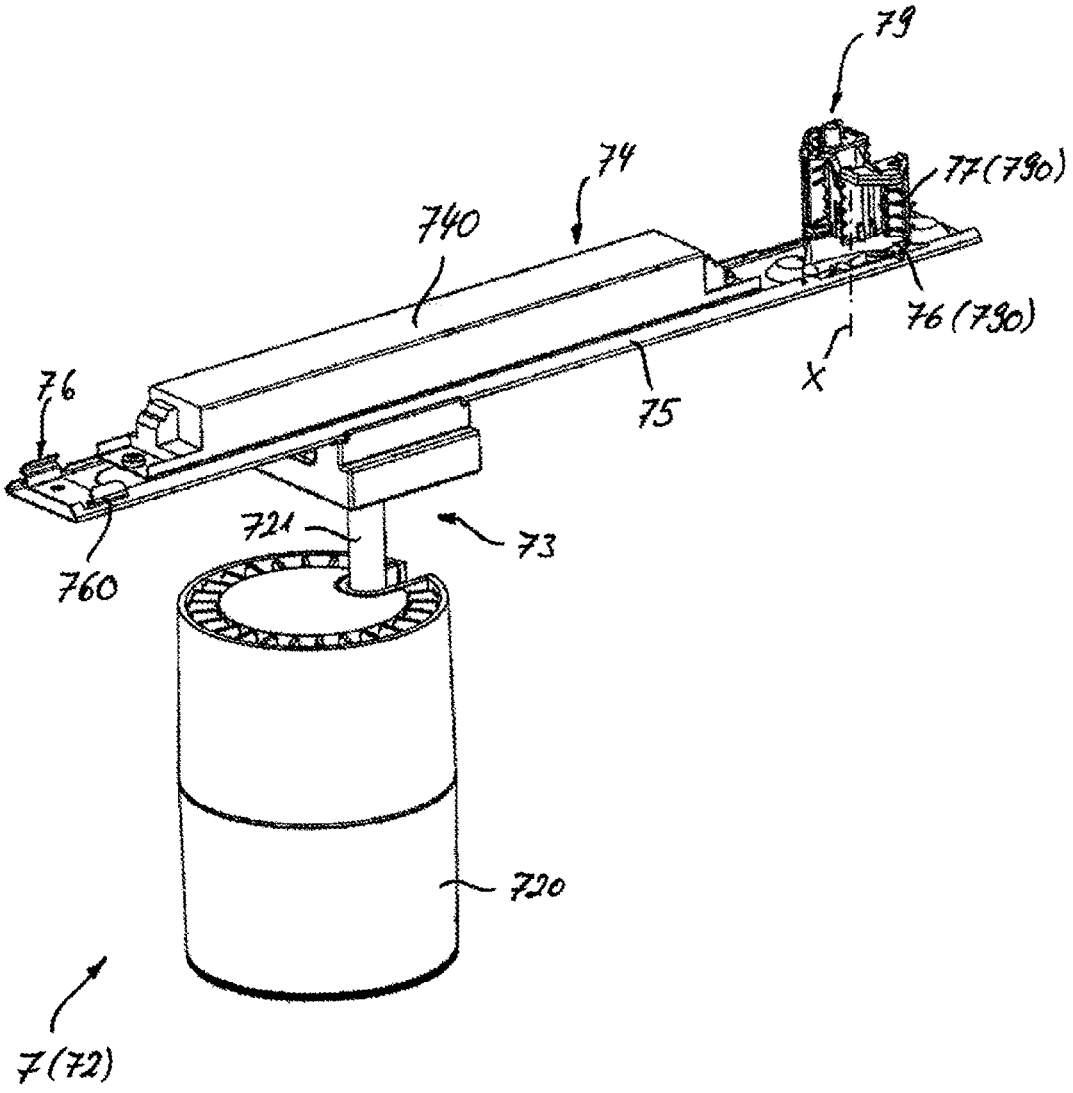
FIG. 22 is a perspective view of a unit of a lighting strip system in accordance with another exemplary embodiment.

The figures show different exemplary embodiments of a lighting strip system 1 according to the present invention. The lighting strip system 1 extends along a longitudinal axis direction L. The latter preferably extends rectilinearly. The lighting strip system 1 according to all the exemplary embodiments has a plurality of components. Thus, the lighting strip system 1 has an elongated carrier profile 2 with two elongated side walls 21, 22 that face each other and an elongated base wall 20 connecting the side walls 21, 22. The side walls 21, 22 and the base wall 20 together delimit a receiving space A. The carrier profile 2 preferably has an essentially U-shaped cross-section as viewed in the longitudinal axis direction L, as can be seen in FIGS. 7, 20 and 21. The base wall 20 and the two side walls 21, 22 of the carrier profile 2 preferably form the essentially U-shaped cross-section as viewed in the longitudinal axis direction L. The open side 23 of the carrier profile 2 opposite the base wall 20 preferably forms a light emission side. The receiving space A is also accessible via this open side 23 so that the latter also serves as a mounting opening for mounting all components of the lighting strip system in the receiving space of the carrier profile 2, as described below. The carrier profile 2 can be provided, for example, as a continuous casting part/extruded part, or as a bent part or a stamped bent part starting from a metal sheet or, according to the particularly preferred embodiment in accordance with FIGS. 7, 20 and 21, as a profile produced in a profiling installation. Other embodiments and materials are of course also conceivable. It is also conceivable for the carrier profile 2 to be formed in several parts in the longitudinal axis direction L, in order to thus be able to provide a carrier profile of any desired length.

As can be seen in particular in FIGS. 7, 20 and 21, the lighting strip system 1 further has a first coupling region 3 and a second coupling region 4. According to the first aspect of the invention, first coupling region 3 is provided, as viewed in the longitudinal axis direction L, cf. thus FIG. 7, between base wall 20 and second coupling region 4. In other words, the first coupling region 3 is arranged behind the second coupling region 4 with a view into the receiving space A through the open side 23, that is to say in the insertion direction E of the components of the lighting strip system 1 described below, that is to say with a view to the base wall 20. Thus, two coupling planes offset relative to each other in the insertion direction E are provided in the insertion direction E or as seen radially. According to the second aspect of the invention, as viewed in the longitudinal axis direction L, the first coupling region 3 is provided on the side of one of the side walls 21 and the second coupling region 4 is provided on the side of the other of the side walls 22, as depicted, for example, in FIGS. 20 and 21.

The first and/or second coupling regions 3, 4 can extend in the longitudinal axis direction L in the receiving space A and, as also shown in the depicted exemplary embodiments, preferably extend over the entire length of the carrier profile 2. The coupling regions 3, 4 can be provided in this case on at least one or, as depicted in the exemplary embodiments, preferably on both side walls 21, 22. In this case, the coupling regions 3, 4 can preferably be formed integrally with the side walls 21, 22. In the exemplary embodiments depicted, this is achieved by a corresponding profiling of the carrier profile 2 so that, as can be seen in FIG. 7, said carrier profile forms, for example, a sawtooth-like structure. The two sawtooth structures form the corresponding mechanical coupling regions 3, 4, which are described in more detail below. The sawtooth structure is achieved here by corresponding bending of the sheet metal carrier profile 2. It is also conceivable for the coupling regions 3, 4 to be provided separately.

In a further preferred embodiment, not depicted in the exemplary embodiments, it is also conceivable for the first mechanical coupling region 3 to have a plurality of coupling regions in planes spaced apart with respect to the base wall 20. Three and more coupling planes provided offset relative to one another in the insertion direction can thus also be provided.

The lighting strip system 1 additionally has an elongated power supply unit 5 which extends in the receiving space A in the longitudinal axis direction L. The power supply unit 5 can be provided between the base wall 20 and the first coupling region 3 and preferably on the base wall 20; for example as a busbar, as depicted in FIG. 7. However, it is also conceivable for the power supply unit 5 to be provided on at least one or both side walls 21, 22 as schematically depicted in FIGS. 20 and 21. In this case, the power supply unit 5 can be designed, for example, as a so-called busbar for rotary tapping, as already described above and depicted schematically in FIGS. 20 and 21 by way of example.

The lighting strip system 1 additionally has a lighting strip lamp 6, which extends in the longitudinal axis direction L. The elongated lighting strip lamp 6 is electrically contacted (this is of course releasable) with the power supply unit 5 and also releasably mechanically coupled to the second coupling region 4 (first aspect) or to both laterally opposite coupling regions 3, 4 (second aspect). The lighting strip lamp 6 preferably has any desired lamp components. These include in particular lighting means 60, such as an LED module with a printed circuit board 61 and LEDs or LED chips 62 arranged thereon, as can be seen by way of example in the cross-sectional view of FIG. 7. These lighting means 60 serve to emit light from the lighting strip system 1. Preferably, the lamp components further have an optical unit 63 for influencing the light emitted by the lighting means 60. The lighting strip lamp can further preferably have a lighting strip carrier 64 which carries the lamp components. This lighting strip carrier 64 can preferably be provided as a profiled metal sheet but also as a continuous casting part/extruded part or bent part or stamped bent part.

The lighting strip lamp 6 is preferably designed to be essentially planar on its outer side F facing away from the receiving space A and further preferably terminates essentially flush with the side 23 of the carrier profile 2 opposite the base wall 20. The lighting strip lamp 6 preferably extends between the two side walls 21, 22. Preferably, it extends completely between the two side walls 21, 22 in order to thus span the entire open side 23 transversely and to create a closed light emission space or a closed light emission side and consequently to produce a harmonious light line appearance. As can be seen in particular from FIGS. 7, 20 and 21, the lighting strip lamp 6 delimits in this case the carrier profile 2 preferably on the side 23 opposite the base wall 20 and preferably covers it essentially completely.

The lighting strip lamp 6 can have electronic components, such as an operating device 65, on its side R facing the receiving space A. Such electronic components 65 are preferably provided spaced apart from the opposite end faces 68 of the lighting strip lamp 6 in the longitudinal axis direction L and are particularly preferably provided at the center of the lighting strip lamp 6. Thus, in the region of the end faces 68 of the lighting strip lamp 6, a large free space is obtained in the receiving space A.

The lighting strip system 1 additionally has an electrical or electronic unit (also called a unit within the scope of the invention) 7. This unit 7 can be any form of electrical or electronic unit 7. Examples mentioned here are lamps, such as spotlights 72 (compare FIGS. 11 to 22) or an emergency light, sensors 70 (cf. FIGS. 1 to 7), such as a PIR sensor 715, AC/DC converters 71 (cf. FIGS. 8 to 10), camera modules, such as a security camera module 711, WLAN modules 713, scanners, projectors, laser projectors, monitoring electronics 70, 711, 715, data transmission systems 713, plug adapters 71 for connecting electrical or electronic components 711, 713, 715 (cf. FIGS. 8 to 10). However, the unit 7 is not limited to the foregoing examples and can comprise any form of electrical or electronic units.

The unit 7 has a functional region 73 and an operating region 74. The functional region 73 can have functional components of the electrical or electronic unit 7. Lamp or spotlight heads 720, preferably with a spotlight shaft 721, a sensor head 700, 715, connection sockets 710, 712, 714, such as USB-C sockets, WLAN antennas 713, camera heads 711 and the like are mentioned here purely by way of example. The operating region 74 can preferably have operating components of the electrical or electronic unit 7. Operating devices 740, a lamp controller, a sensor processing unit, an AC/DC converter unit and the like are mentioned here purely by way of example. The unit 6 or the operating region 74 can have a unit carrier 75, for example a carrier plate, on which at least a part of the components of the unit 6, preferably all components of the operating region 74 and further preferably of the functional region 73, are arranged.

Figure 8:
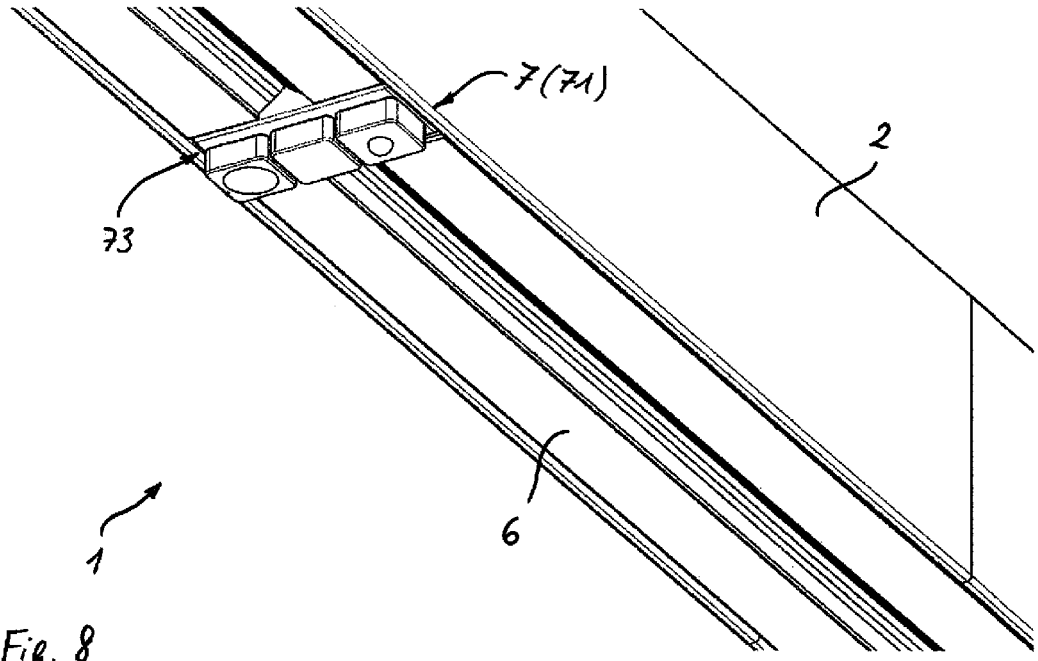
FIG. 8 is a perspective view of a lighting strip system according to a second exemplary embodiment of the invention.
Figure 9:
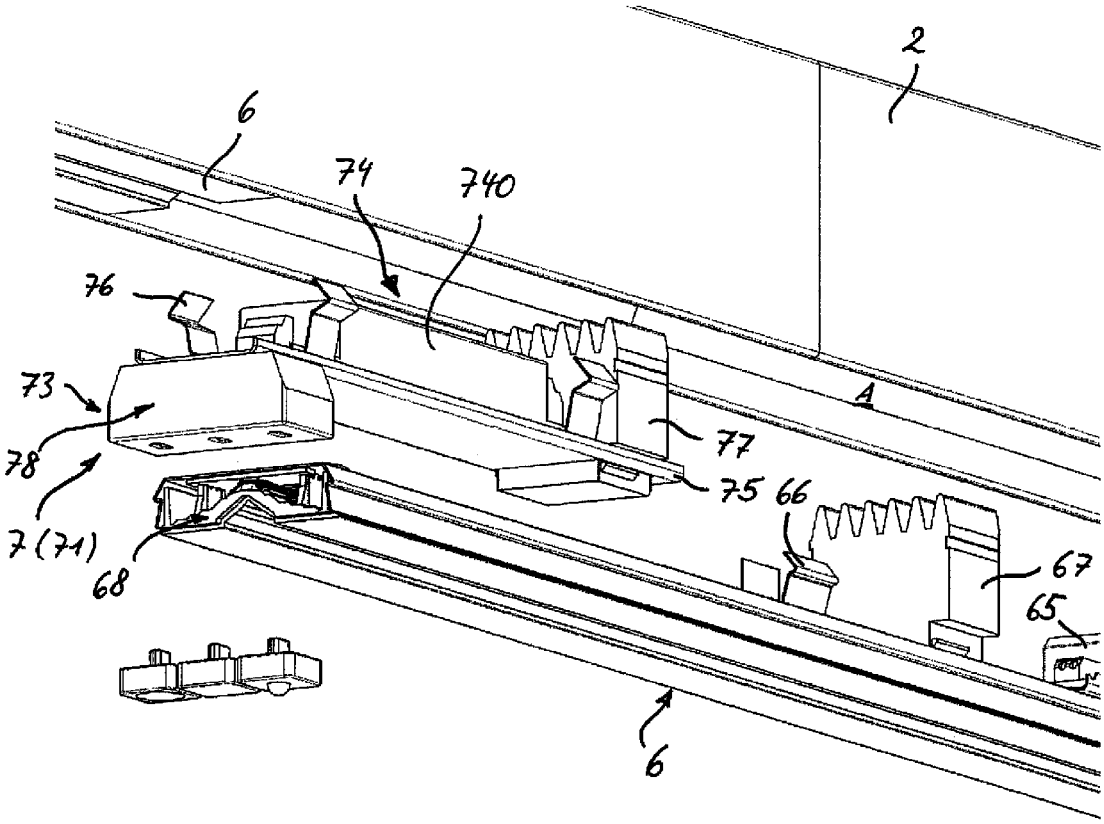
FIG. 9 is an exploded perspective view of the lighting strip system in accordance with FIG. 8.
Figure 10:
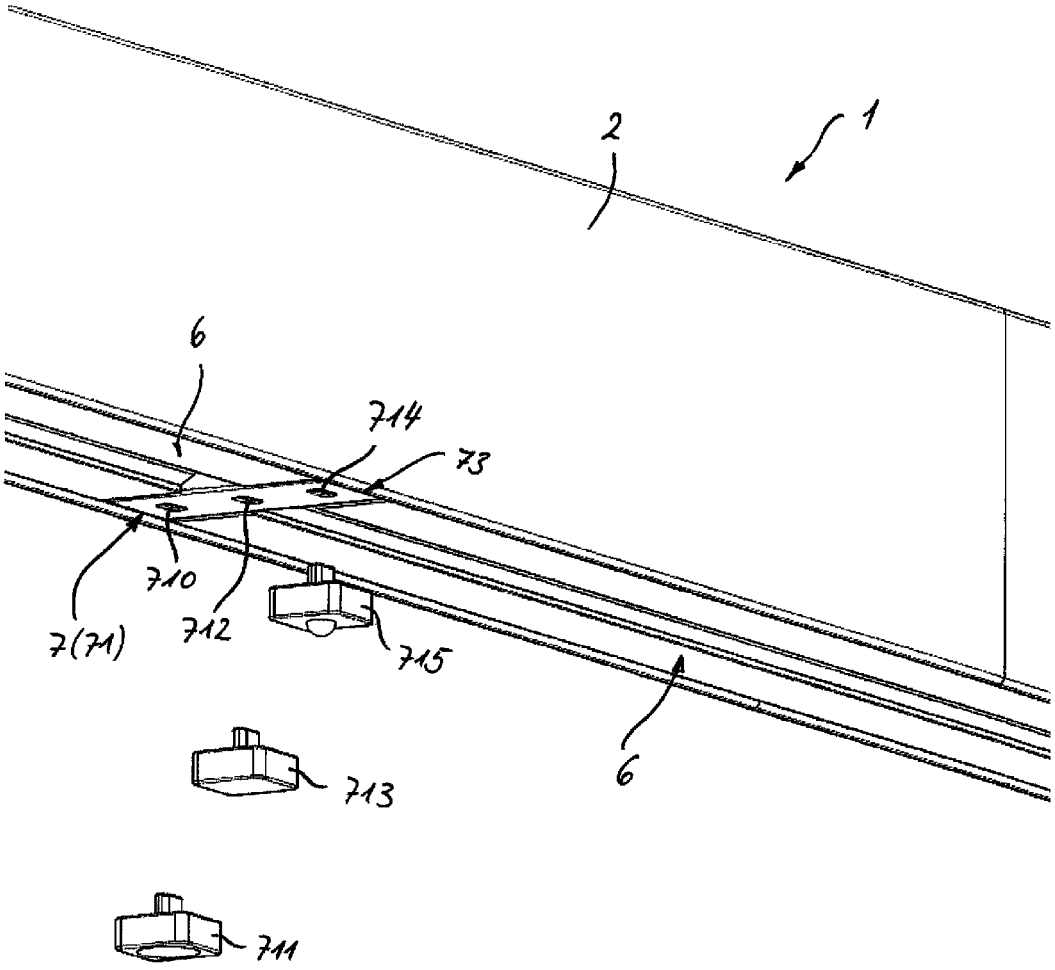
FIG. 10 is a perspective view of the lighting strip system in accordance with FIG. 8 with non-plugged-in electrical or electronic components.
Figure 11:
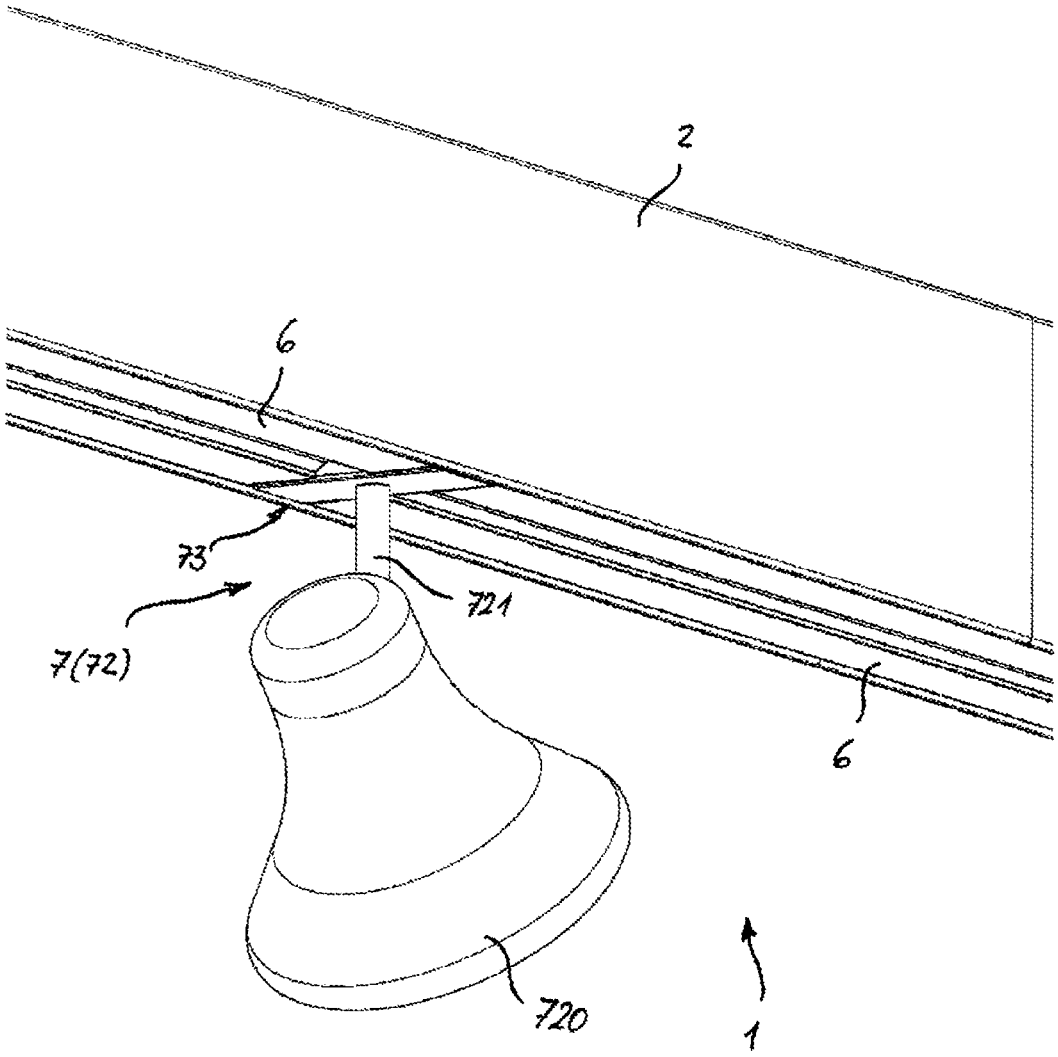
FIG. 11 is a perspective view of a lighting strip system in accordance with a third exemplary embodiment of the invention.
Figure 12:
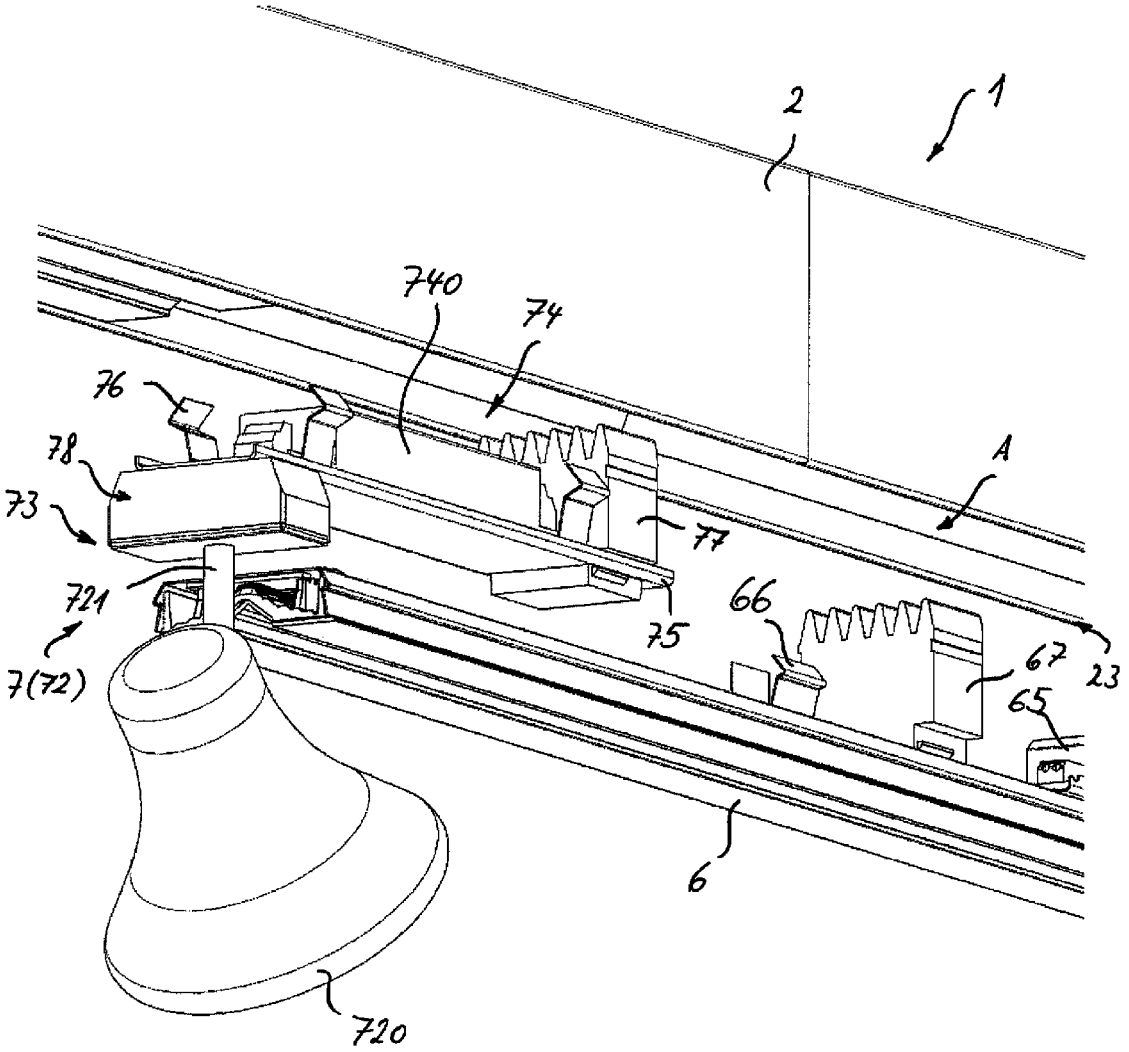
FIG. 12 is an exploded perspective view of the lighting strip system in accordance with FIG. 11.
Figure 13:
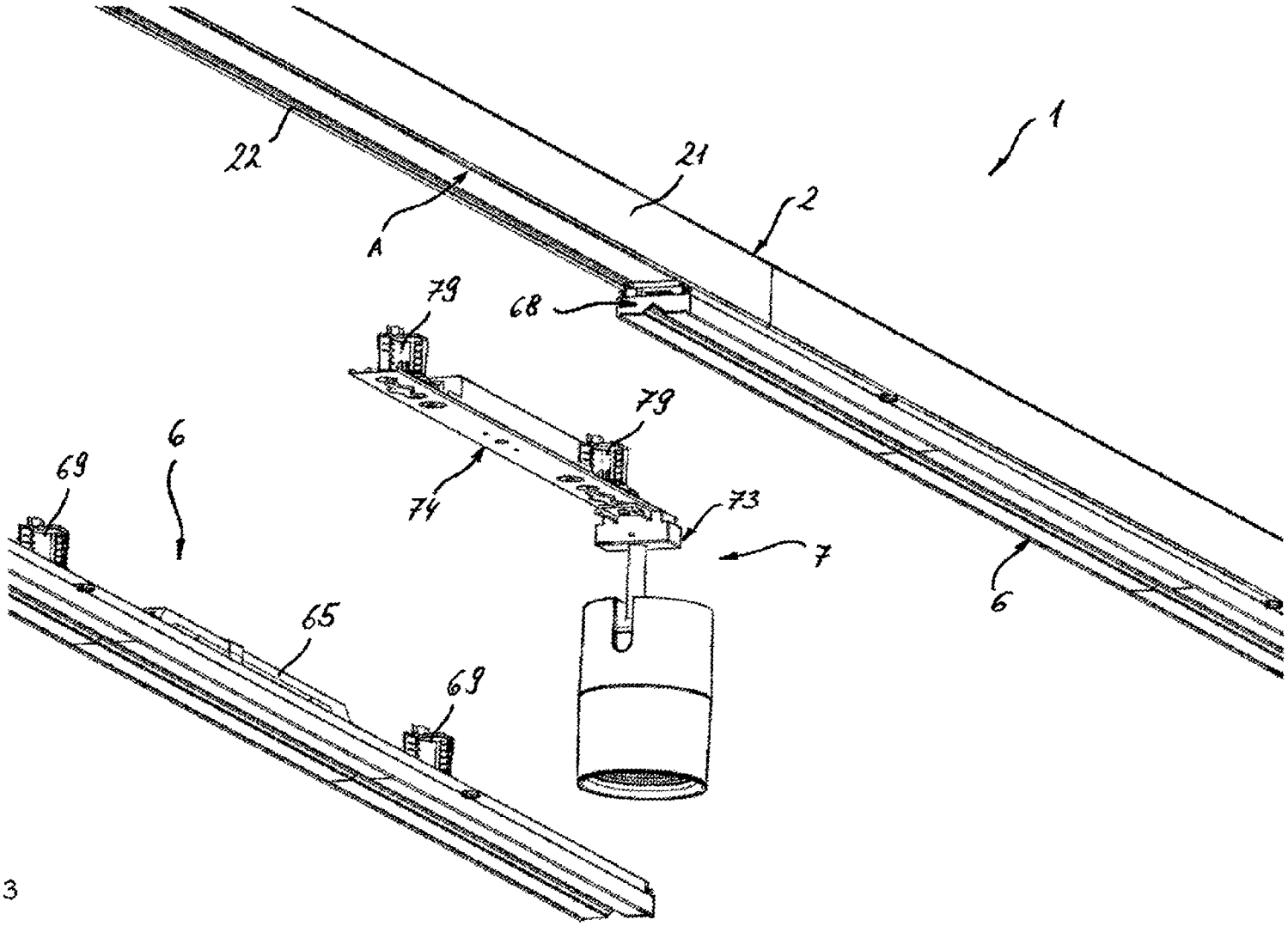
FIG. 13 is a perspective view of a lighting strip system in accordance with a fourth exemplary embodiment of the present invention in a partial exploded view.
Figure 14:
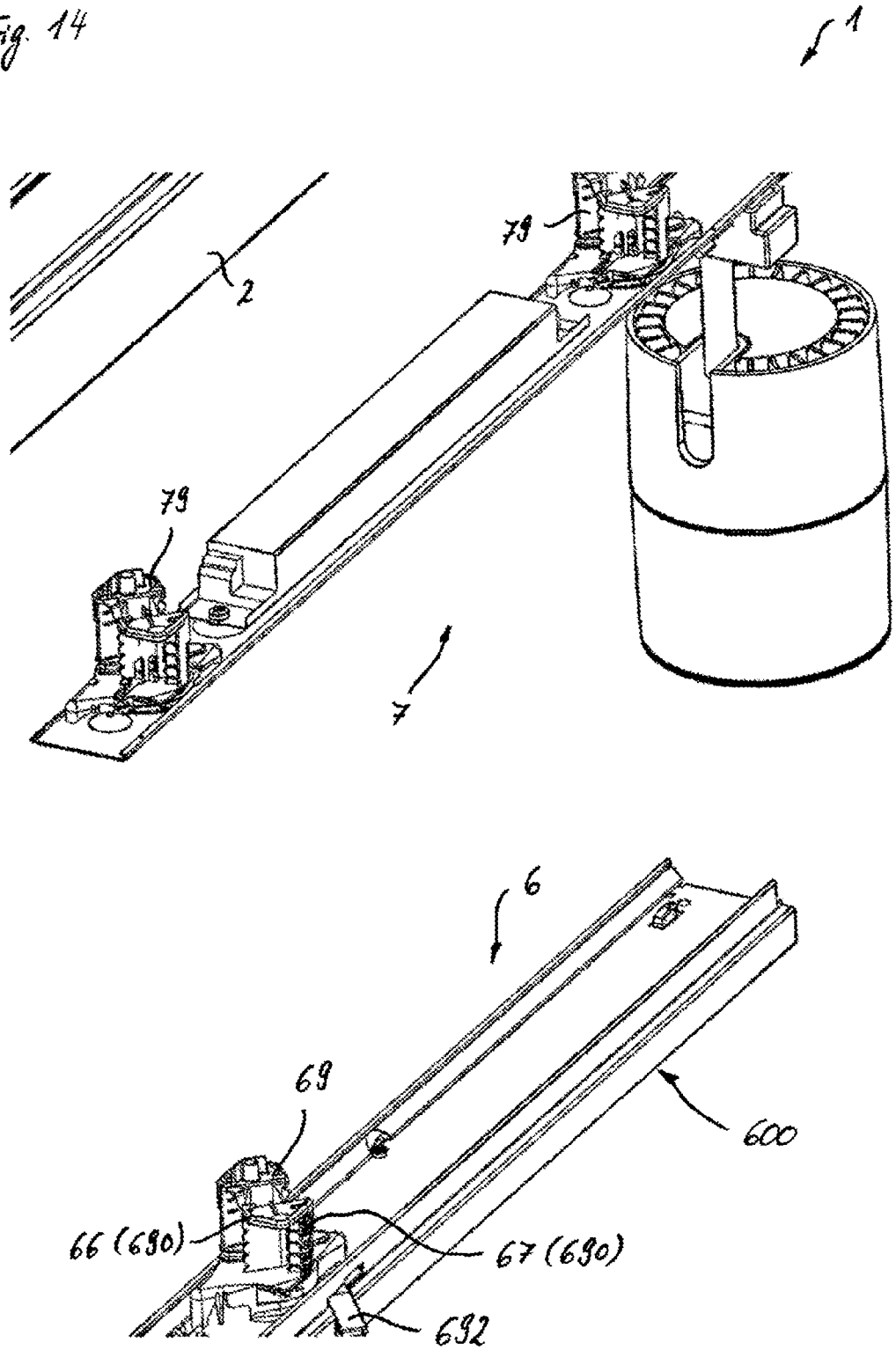
FIG. 14 is a detailed view of the lighting strip system in accordance with FIG. 13 in another perspective view.
Figure 15:
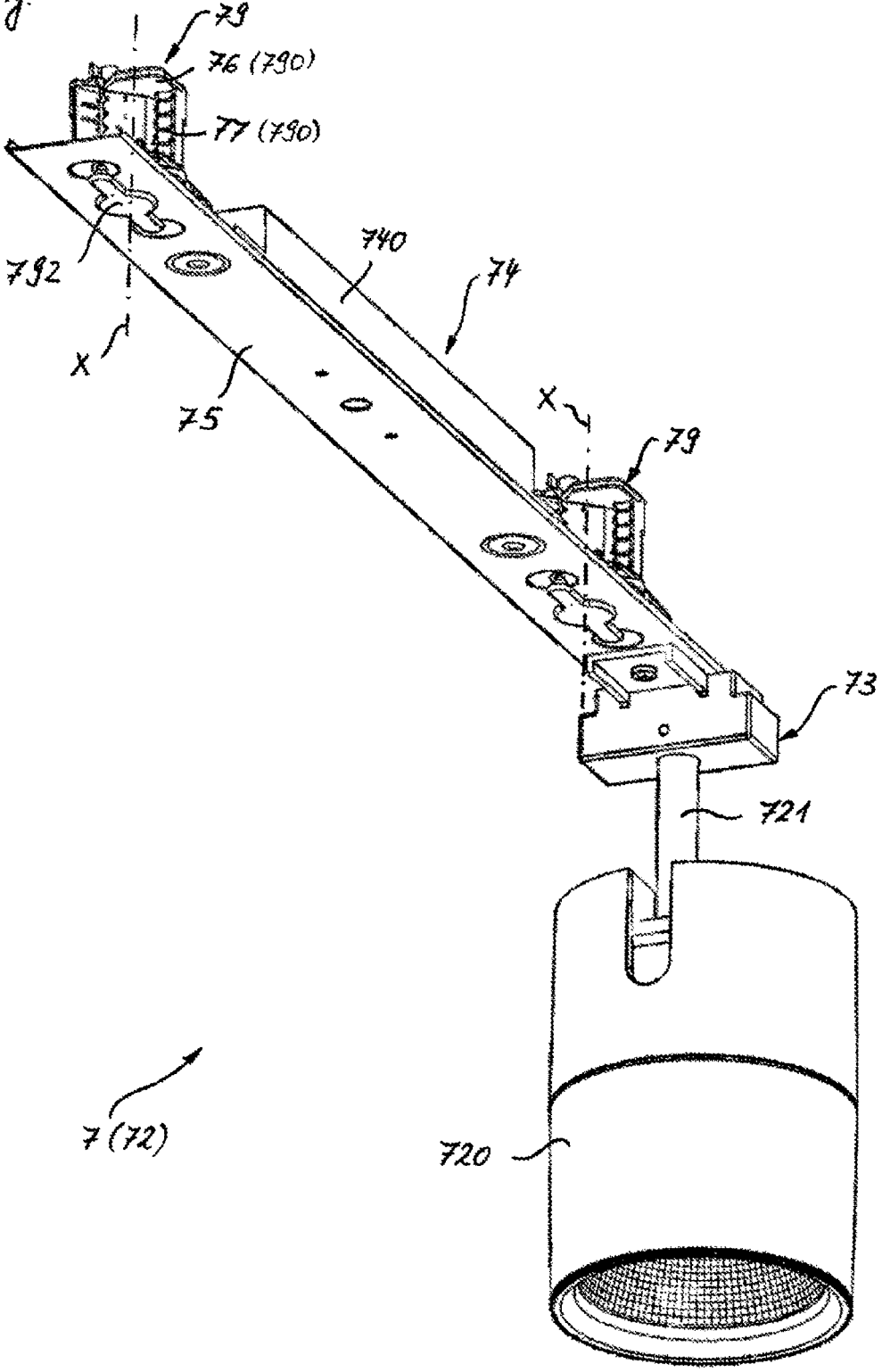
FIG. 15 is a perspective view of the unit in the form of a spotlight/spot of the lighting strip system in accordance with FIG. 14.
Figure 16:
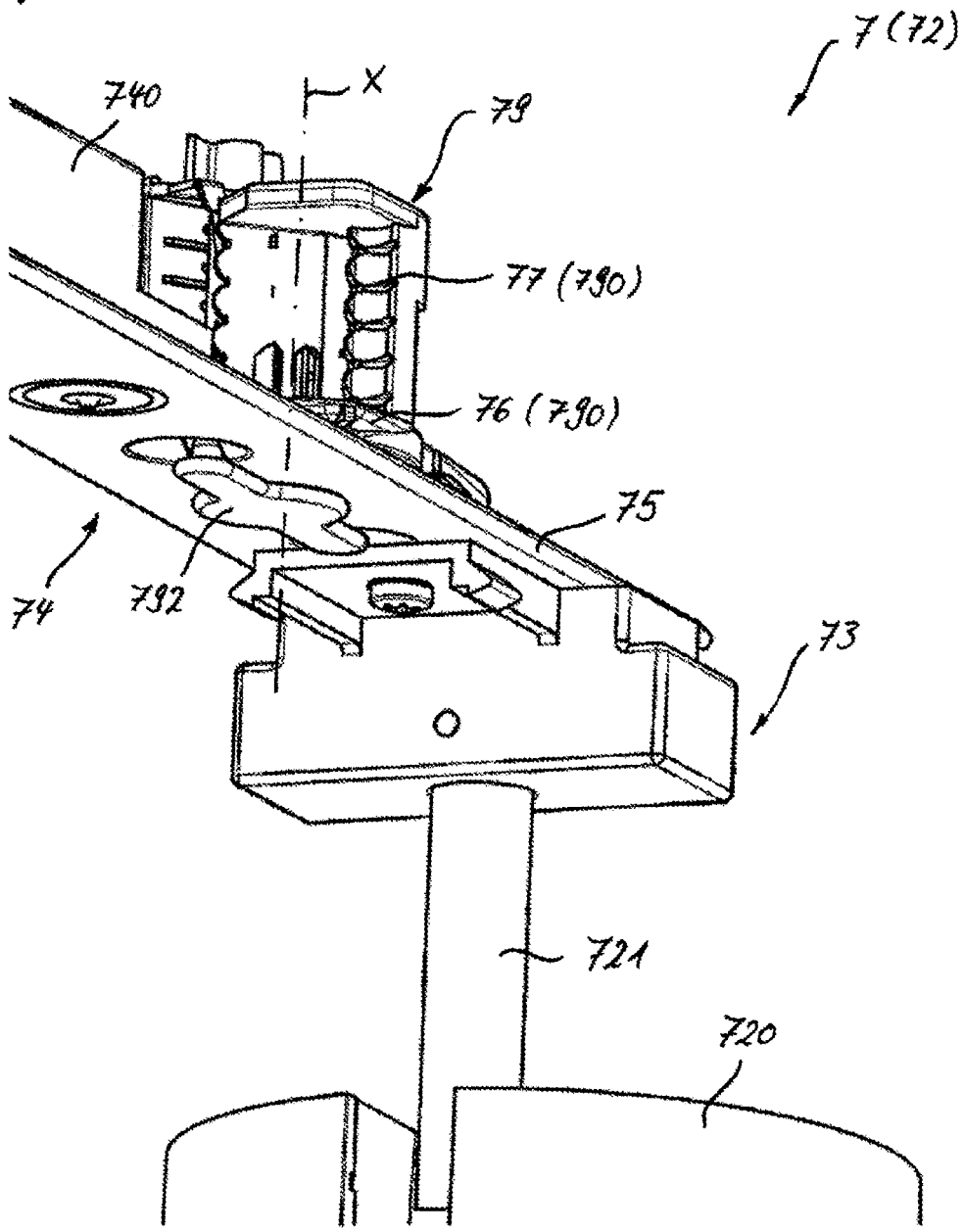
FIG. 16 is a detailed view of the unit in accordance with FIG. 15.

In particular, the unit 7 depicted in FIGS. 8 to 10 in the embodiment of a USB adapter 71 offers innumerable possibilities of use via its standardized connection sockets 710, 712, 714; and this essentially without impairing the light line since only the connection socket region (functional region 73) is provided in a manner exposed to the outside, while the operating region 74 extends in the receiving space A behind the lighting strip lamp 6. The USB adapter 71 provides both a mechanical and an electrical connection possibility. It also serves as a data interface. It enables access to cable-connected ("wired") or cable-less ("wireless") data networks, depending on the underlying system. It can also use components such as WLAN-enabled drivers. If such an adapter 71 has a network-enabled driver with a LAN connector output, LAN sockets can also be integrated into the connection socket region (functional region 73) in addition to the USB sockets 710, 712, 714 shown here. This system thus effectively serves as an innovation platform for a plurality of technical developments, which can then easily be connected to the adapter 71. FIGS. 8 to 10 show, by way of example, a PID sensor module 715, a security camera module 711 and a WLAN stick or WLAN module 713.

The functional region 73 is arranged adjacent to the lighting strip lamp 6 in the longitudinal axis direction L. For this purpose, the functional region 73 preferably extends between the two side walls 21, 22; similarly to the lighting strip lamp 6. This can be clearly seen in FIG. 1, for example. There, the functional region 73 preferably extends here completely between the two side walls 21, 22. The functional region 73 preferably lies flush with and particularly preferably gap-free against the lighting strip lamp 6 in the longitudinal axis direction L, as can be seen in particular in FIGS. 1, 8, 11, 18*b* and 18*c*. In this way, it can be enabled to delimit or even cover the carrier profile 2 on the side 23 opposite the base wall 20 preferably in a gap-free manner and thus to close the lighting strip system 1 on its open side 23, in order to thus be able to produce an overall harmonious light line appearance on the light emission side.

The functional region 73 can be provided with respect to the longitudinal axis direction L in a region of one of the end faces of the operating region 74 opposite in the longitudinal axis direction L, preferably on one of the end faces (that is to say at the edge), as depicted by way of example in FIGS. 1 to 16. Consequently, the operating region 74 extends on one side away from the functional region 73. Alternatively, it is also conceivable for the functional region 73 to be provided spaced apart from both end faces of the operating region 74, as depicted, for example, in FIGS. 17 to 22. In a particularly preferred embodiment, the functional region 73 can also be provided to be movable relative to the operating region 74 in the longitudinal axis direction L.

The operating region 74 extends starting from the functional region 73 at least partially between the lighting strip lamp 6 and the base wall 20. In this way, a free space in the receiving space A between the lighting strip lamp 6 and the base wall 20 can be effectively utilized. The operating region 74 is in this case (releasably) electrically contacted with the power supply unit 5 and, when the first coupling region 3 is arranged between the base wall 20 and the second coupling section 4 as viewed in the longitudinal axis direction L, is releasably mechanically coupled to the first coupling region 3 (see FIGS. 1 to 12) or, when the coupling regions 3, 4 are arranged on the opposite sides of the side walls 21, 22 that face each other, to the coupling regions 3, 4 (see FIGS. 13 to 22).

The first and/or the second coupling region 3, 4 can be formed by profile regions, such as a latching profile, of the side walls 21, 22 (cf. FIGS. 1 to 22) or else of the power supply unit 5 (cf. FIGS. 13 to 22). It is also conceivable for the first and/or the second coupling region 3, 4 to be formed by recesses, such as punches, in the side walls 21, 22 or in the power supply unit 5. In other words, it is also conceivable for the first and/or the second coupling region 3, 4 to be provided on the power supply unit 5 and preferably also to be formed integrally with it. The latter is conceivable in particular when, for example, the power supply unit 5 is provided in the form of a busbar and the profiling, for example of the side walls 21, 22 or of the power supply unit 5 (as depicted schematically in FIGS. 20 and 21), forming the busbar thus likewise enables mechanical coupling.

In accordance with a preferred embodiment, the electrical or electronic unit 7 can have a first coupling element 76 corresponding to the first coupling region 3 (cf. FIGS. 1 to 22) and preferably further to the second coupling region 4 (cf. FIGS. 13 to 22) for mechanically coupling to the first coupling region 3 and preferably further to the second coupling region 4. Preferably, the operating region 74, preferably its unit carrier 75, carries the first coupling element 76. Similarly, the lighting strip lamp 6 can also have a second coupling element 66 corresponding to the second coupling region 4 (cf. FIGS. 1 to 22) and preferably further to the first coupling region 3 (cf. FIGS. 13 to 22) for mechanically coupling to the second coupling region 4 and preferably further to the first coupling region 3. The lighting strip carrier 64 can also preferably carry the second coupling element 66. As depicted in the exemplary embodiments in FIGS. 1 to 12, 17 and 22, the first and/or the second coupling element 66, 76 can have latching springs, pretensioned laterally to the respective coupling regions 3, 4, with a first latching section, preferably a V-shaped latching section 660, 760 projecting outward. The first latching section 660, 760 interacts in a latching manner with a corresponding second latching section 30, 40 of the respective coupling region 3, 4 in order to provide the mechanical coupling.

As can be seen in particular from FIGS. 5, 9, 12 to 14 and 17, the lighting strip lamp 6 can have a first electrical contacting element 67 and the unit 7, preferably the operating region 74, can have a second electrical contacting element 77. These serve for electrically contacting the lighting strip lamp 6 or the unit 7 preferably directly when the same is inserted into the receiving space A or when mechanically coupling the same to the respective mechanical coupling region 3, 4. The electrical contacting elements 67, 77 can be designed in cooperation with the power supply unit 5, with which they are to be electrically contacted, in such a way that, as shown in the figures, they establish a contact between the tapping agent and the conductors of the busbar (cf. in particular FIGS. 1 to 12). In accordance with further possibilities, they can, for example, enable rotary tapping when a busbar integrated into the side wall is formed (cf. FIGS. 13 to 22), but they can also be designed, for example, as an insulation-displacement tap (not depicted in the exemplary embodiments) or also as a socket system tap.

In a particularly preferred embodiment, the first and second electrical contacting elements 67, 77 can be constructed identically. Consequently, identical parts can be used in order to electrically contact different components with the same power supply unit 5 even in different mechanical coupling planes or coupling sides.

As depicted in the exemplary embodiments and as can be seen in particular in the lateral sectional views in FIGS. 2, 4, 6, 13, 20 and 22, the first electrical contacting element 67 can extend in a first extension direction in a region between the lighting strip lamp 6 and the base wall 20 (that is to say in an insertion direction E). In this case, the first electrical contacting element 67 preferably projects from the lighting strip lamp 6 into the receiving space A as far as the power supply unit 5. Thus, electrical contact with the power supply unit 5 is automatically provided when the lighting strip lamp 6 is completely mechanically coupled (optionally after rotation in the case of rotary tapping, as described below). The lighting strip carrier 64 can preferably carry the first electrical contacting element 67.

Similarly, the second electrical contacting element 77 can also extend in a second extension direction in a region between the lighting strip lamp 6 and the base wall 20 (that is to say in the insertion direction E). In this case, particularly when using identical parts, the second electrical contacting element 77 is provided in such a way that it extends in a protruding manner on both sides of the operating region 74 with respect to the previously named extension direction; thus penetrates the operating region 74. Alternatively, as can be seen from FIGS. 14 and 17, the second electrical contacting element 77, for example, can be provided raised toward the base wall 5 in order to thus be provided at the same height as the first electrical contacting element 67 with respect to the extension direction of such base wall. In this way, despite the use of identical parts, consideration can be given to a reduced distance of the operating region 74 from the power supply unit 5 in comparison with the distance of the lighting strip lamp 6 from the power supply unit 5. The use of contacting elements 67, 77 as identical parts can be clearly seen, for example, in FIGS. 6 and 14. Preferably, the operating region 74, preferably its unit carrier 75, carries the second electrical contacting element 77.

Alternatively or additionally, a rotary tap already described above is also conceivable, which serves for electrical coupling, mechanical coupling or electrical and mechanical coupling. For this purpose, the lighting strip lamp 6 and/or the electrical or electronic unit 7 can have one or more (for example at least two) rotary bodies 69, 79 rotatably provided about a rotational axis X with laterally protruding latching projections 690, 790 which, by rotating the rotary body 69, 79 about its rotational axis X, can be moved between a retracted mounting position (cf., for example, FIGS. 14, 17, 18*a*) for inserting the lighting strip lamp 6 or electrical or electronic unit 7 into the carrier profile 2 and an extended positions (not depicted; cf. FIG. 18*c* by way of example) for interacting with the coupling regions 3, 4 for mechanical coupling and/or the power supply unit 5 for electrical coupling. For this purpose, the latching projections preferably have the coupling elements 76, 66 and/or the electrical contacting elements 67, 77.

For example, the rotary bodies 69, 79 of the exemplary embodiment in FIGS. 13 to 16 can both provide both mechanical and electrical coupling; as a rule, at least one rotary body 69, 79 should enable electrical coupling and at least one, but preferably all, should enable mechanical coupling.

Figure 17:
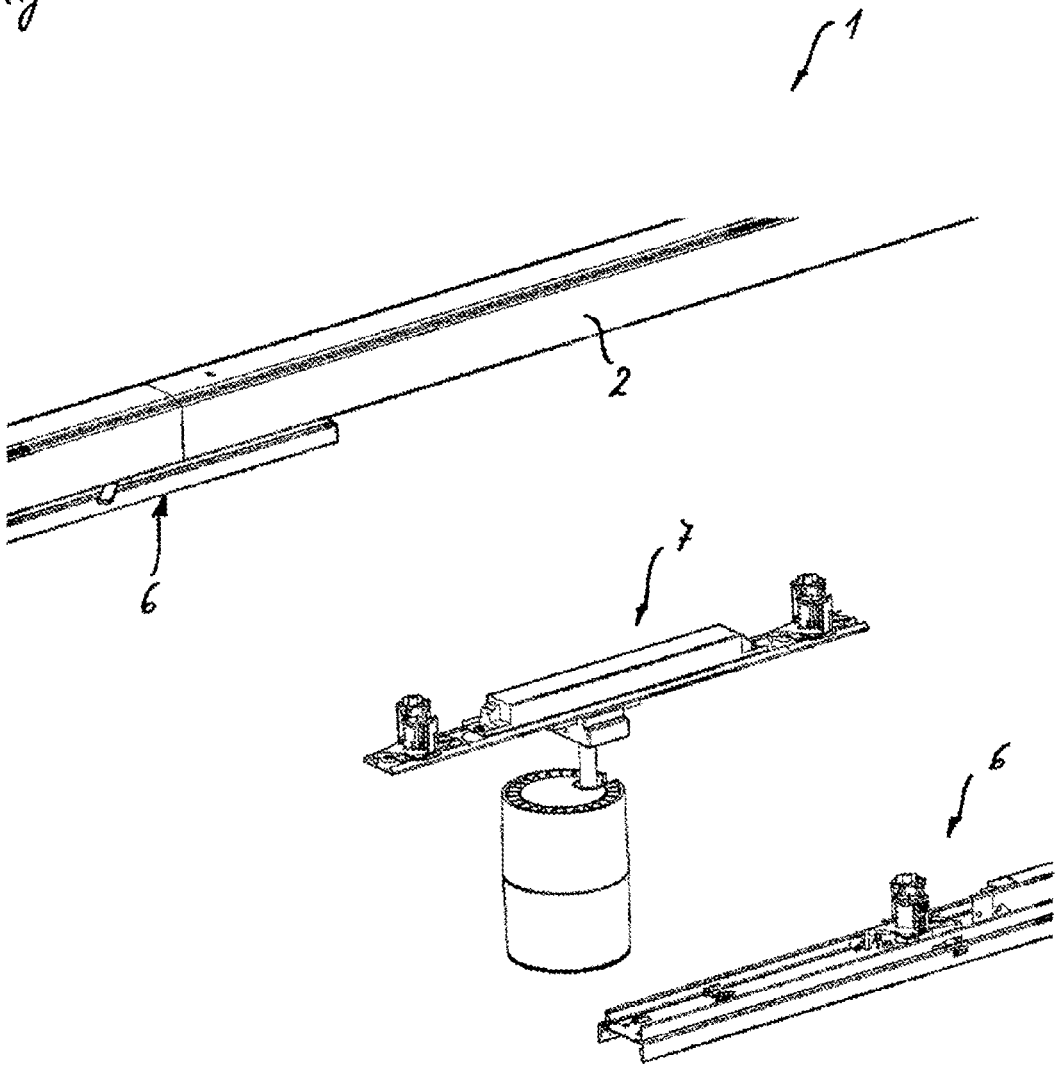
FIG. 17 is a perspective view of a lighting strip system in accordance with a fifth exemplary embodiment of the present invention in a partial exploded view.
Figure 18:
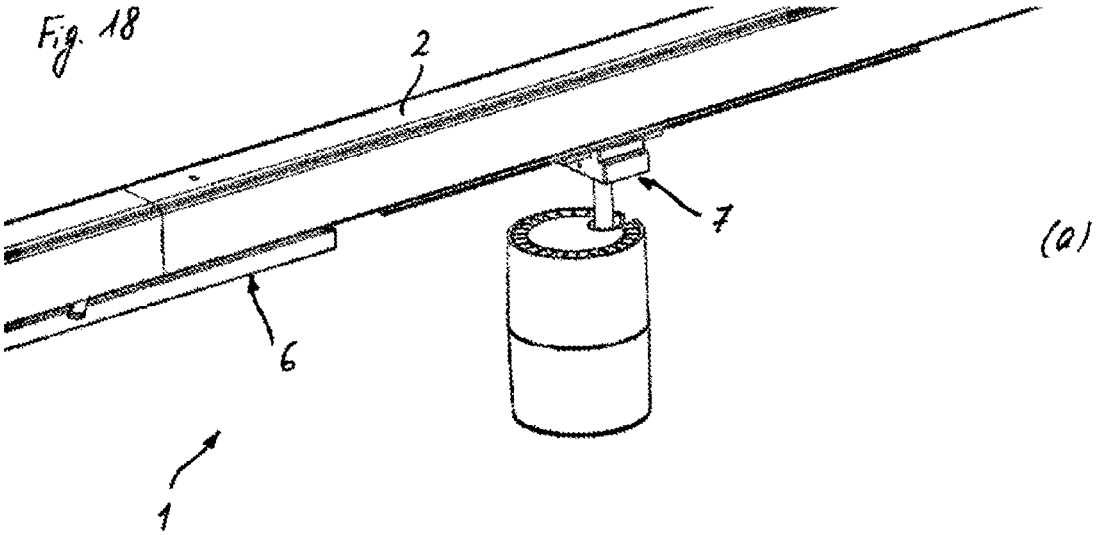
FIG. 18 is three perspective views of the lighting strip system in accordance with FIG. 17 (a) with the unit inserted, (b) with the unit installed, and (c) in the fully assembled state.
Figure 18:
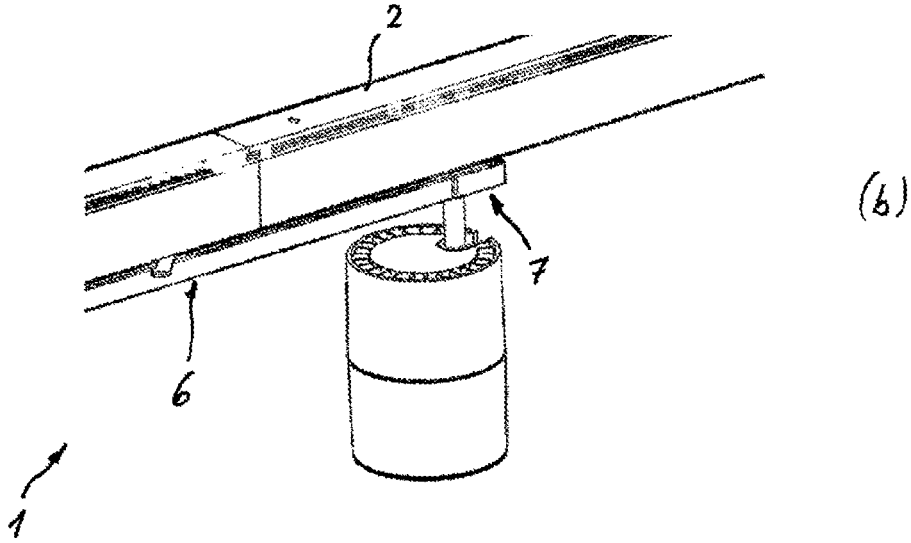
Figure 18:
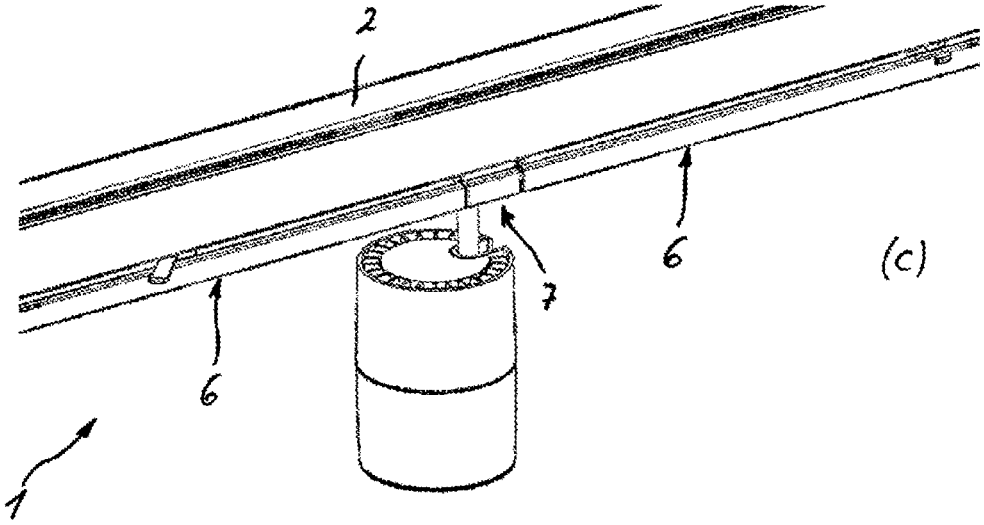
Figure 19:
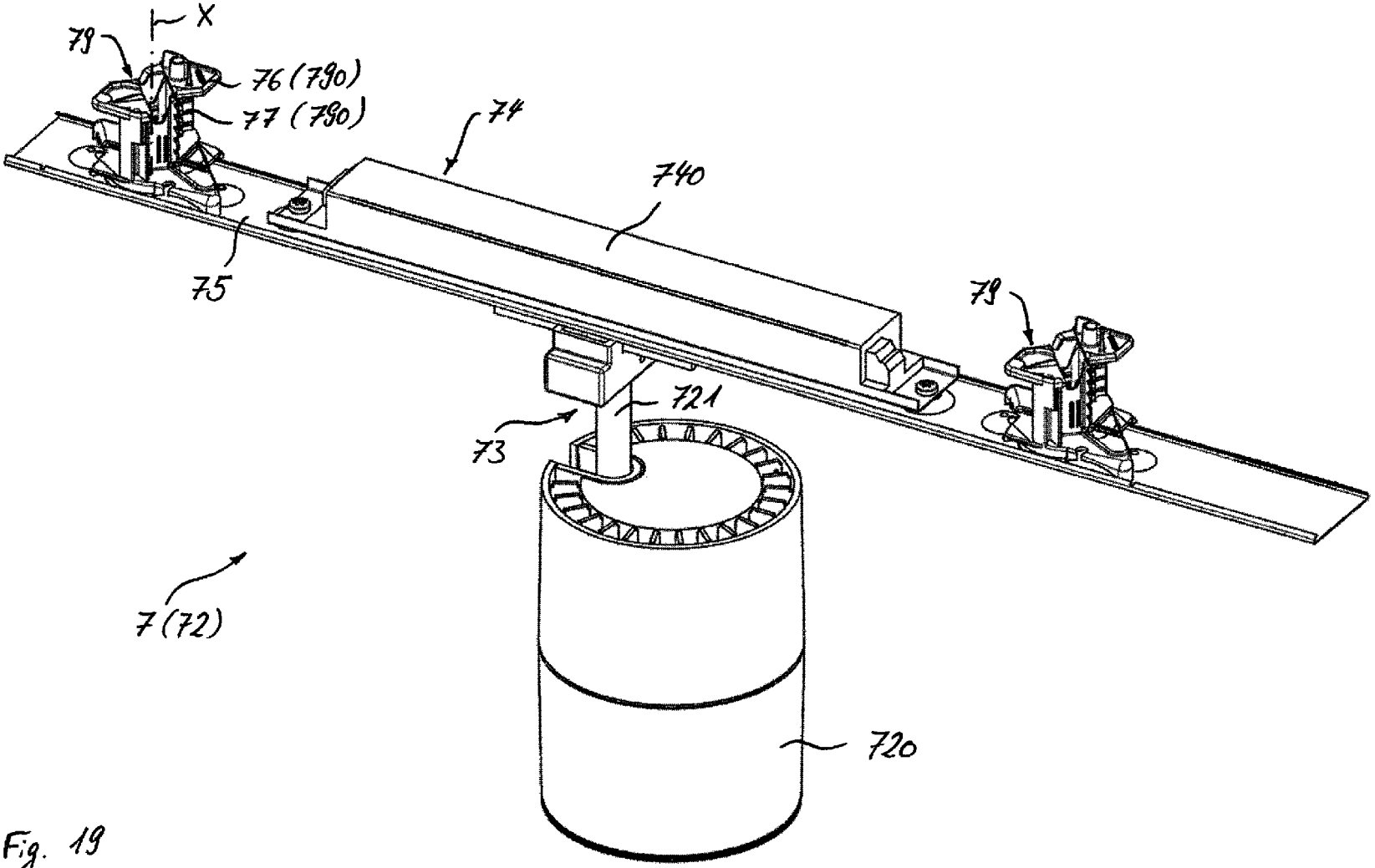
FIG. 19 is a perspective view of a unit of the lighting strip system in accordance with FIG. 17.

As a result of the edge-side arrangement of the functional region 73 with respect to the operating region 74, it is then conceivable, for example, to insert the unit 7 after the installation of a lighting strip lamp 6 and to couple it electrically and mechanically by means of a rotary tap. The operating region 74 which then extends away from the installed part of the lighting strip lamp 6 can then be covered toward the front by installing a further part of the lighting strip lamp 6. This in turn requires a comparatively long free end 600 of the part of the lighting strip lamp 6 covering the operating region 74. Since, in particular when providing the coupling by means of a rotary tap, the rotary body 69 has to be arranged in a manner offset in the longitudinal axis direction L next to the unit 7, in order to couple it to the coupling regions 3, 4 and power supply unit 5, the second coupling element 66 can also have a further latching means, like the latching springs described above, in addition to the corresponding latching projection 670, as also depicted in FIG. 17. In this way, the lighting strip lamp 6 preferably has the second coupling region 66 (or a part thereof) in the form of latching springs in the region between at least one of the end faces 68 and electronic component.

It is also conceivable, as can be seen, for example, from the exemplary embodiment in FIGS. 17 to 22, for the operating region 74 to extend from the functional region 73 on both sides with respect to the longitudinal axis direction L. Thus, a smaller overlap of unit 7 with the adjoining part of the lighting strip lamp 6 occurs. The components are then installed, for example, in such a way that first the unit 7 lying in the rear plane is installed and electrically and mechanically coupled by means of the rotary bodies 79, and then the adjoining parts of the lighting strip lamp 6 are installed in a manner connecting thereto.

It is also conceivable in all the exemplary embodiments for the coupling regions 3, 4 in conjunction with the respective coupling elements 66, 76 to preferably permit a sliding movement of the lighting strip lamp 6 or of the electrical or electronic unit 7 along the longitudinal axis direction L; thus enabling form closure transversely to the longitudinal axis direction L in order to hold the unit 7 in the carrier profile 2. For this purpose, the latching springs, for example, in accordance with the exemplary embodiments in FIGS. 1 to 12 and 22 can be designed accordingly. Moreover, for example, it is also possible, as shown in FIG. 17, to first install a part of the lighting strip lamp 6 and to couple it by means of a rotary tap. As shown in FIG. 18*a*, the unit 7 can then be inserted and first only mechanically coupled, here, for example, by means of the left rotary tap 79 (alternatively by means of the latching spring in accordance with FIG. 22). The unit 7 can then be displaced toward the installed part of the lighting strip lamp 6 until its functional region 73 bears against the lighting strip lamp 6. Then, in the position in accordance with FIG. 18*b*, the second rotary body 79 can also be actuated (i.e., rotated about the rotational axis X), in order to bring about an electrical and preferably also a fixed mechanical coupling via the latter. As shown in FIG. 18*c*, a further part of the lighting strip lamp 6 can then be installed so that it, with the other part of the lighting strip lamp 6, laterally encloses the functional region 73 opposite of the unit 7 and covers the part of the operating region 74 that was previously exposed to the outside. In particular in accordance with this embodiment, at least one of the rotary bodies 69, 79 can have no latching projections 690, 790 (67, 77) for electrical coupling, wherein the mechanical coupling 690, 790 (66, 76) preferably permits a sliding movement of the lighting strip lamp 6 or of the electrical or electronic unit 7 along the longitudinal axis direction L.

The rotary body 69, 79 can have a rotary manipulator 692, 792 for rotating the rotary body 69, 79 about its rotational axis X. The rotary manipulator 692, 792 can preferably extend away radially on one side (rotary manipulator 692) or on multiple sides, preferably on two sides (wing-like rotary manipulator 792). In this case, it can be arranged centrally or coaxially or symmetrically or asymmetrically as viewed with respect to the rotational axis X. While the wing-like design of the rotary manipulator 792 enables easy access thereto, the one-sided and lever-like design of the rotary manipulator 692 has the advantage that it leaves the downwardly directed emission region of the lighting strip lamp 6 free and thus does not impede the emission of light.

Thus, both the lighting strip lamp 6 and the unit 7 can be inserted into the carrier profile 2 preferably via the open side 23 for mechanical coupling with the respective coupling regions 3, 4 while, due to the coupling planes or coupling sides provided offset from one another, an overall significantly more compact design of the lighting strip system is enabled. Regions or components of the unit 7 which are not required for an outwardly exposed provision can be completely accommodated in the receiving space A. The installation space for the unit 7 which takes up the light line or the light emission side 23 is thus reduced overall so that overall in comparison with currently known solutions a clearly more harmonious and largely interruption-free and gap-free light line can be created.

In particular, the functional region 73 can thus also be designed to be essentially planar on its side S facing away from the receiving space A. This side S is particularly preferably essentially flush with the side 23 of the carrier profile 2 opposite the base wall 20 and further preferably terminates with the planar outer side F of the lighting strip lamp 6.

Like the carrier profile 2, the lighting strip lamp 6 can also be formed in several parts in the longitudinal axis direction L. In this case, at least some parts of the lighting strip lamp 6 that are adjacent to one another can preferably adjoin one another flush and preferably gap-free in the longitudinal axis direction L. A functional region 73 of an electrical or electronic unit 7 can be arranged at least between two parts of such a multipart lighting strip lamp 6, as already described above.

The end faces 68, 78, directed in the longitudinal axis direction L, of the lighting strip lamp 6 and the functional region 73 are preferably flat and particularly preferably oriented transversely to the longitudinal axis direction L.

The present invention is not limited to the number of adjacent carrier profiles 2, power supply units 5, lighting strip lamps 6, units 7, in particular functional regions 73, first and second coupling regions or coupling planes. The present invention is also not limited to a number or type of units 7. Any type of electrical or electronic unit 7 and any combination thereof within a lighting strip system 1 are conceivable. These can also all be placed directly next to one another, wherein then correspondingly preferably a plurality of the above-described first coupling regions are provided in different coupling planes. The present invention is also not limited to the type of electrical or mechanical coupling. The features of the present exemplary embodiments can be combined and exchanged in any way with and among one another, provided that they are encompassed by the subject matter of the following claims.

The invention claimed is:

1. A lighting strip system (1) that extends along a longitudinal axis direction (L), having:

an elongated carrier profile (2) with two elongated side walls (21, 22) that face each other and an elongated base wall (20) connecting the side walls (21, 22), which together delimit a receiving space (A);

a first and a second mechanical coupling region (3, 4), wherein the first coupling region (3) is provided between the base wall (20) and the second coupling region (4) as viewed in the longitudinal axis direction (L), wherein the first and second coupling regions (3,4) extend in the longitudinal axis direction (L) in the receiving space (A) over the entire length of the carrier profile (2);

an elongated power supply unit (5) which extends in the longitudinal axis direction (L) in the receiving space (A);

a lighting strip lamp (6) which is located between the two side walls of the elongated carrier profile and extends in the longitudinal axis direction (L) to emit light along an open side of the elongated carrier profile opposite the base wall, is electrically contacted with the power supply unit (5) and is releasably mechanically coupled to the second coupling region (4); and an electrical or electronic unit (7) that is different from the lighting strip lamp and has a functional region (73) and an operating region (74), wherein the functional region (73) is arranged adjacent to the lighting strip lamp (6) in the longitudinal axis direction (L) along the open side of the elongated carrier profile, and wherein the operating region (74) extends starting from the functional region (73) at least partially between the lighting strip lamp (6) and the base wall (20), is electrically contacted with the power supply unit (5) and is releasably mechanically coupled to the first coupling region (3);

wherein the lighting strip lamp (6) has a second coupling element (66) for coupling to the second coupling region (4), and the electrical or electronic unit (7) has a first coupling element (76) for coupling to the first coupling region (3); and further wherein the lighting strip lamp (6) has a first electrical contacting element (67) that makes electrical contact with the elongated power supply and the operating region (74) of the electrical or electronic unit (7) has a second electrical contacting element (77) that makes electrical contact with the elongated power supply.

2. The lighting strip system (1) according to claim 1, wherein the first and the second coupling regions (3, 4) are provided on both side walls (21, 22) and integrally formed therewith.

3. The lighting strip system (1) according to claim 1, wherein the first and the second coupling regions (3, 4) are formed by profile regions that are latching profiles, of the side walls (21, 22) or recesses punched in the side walls (21, 22).

4. The lighting strip system (1) according to claim 1, wherein the first and second coupling regions (3, 4) in conjunction with the respective first and second coupling elements (66, 76) permit a sliding movement of the lighting strip lamp (6) or of the electrical or electronic unit (7) along the longitudinal axis direction (L).

5. The lighting strip system (1) according to claim 4, wherein the first and second coupling elements (76, 66) each have latching springs, pretensioned laterally to the respective first and second coupling regions (3, 4), with a first latching section (760, 660), comprising a V-shaped latching section that projects outward, wherein the first latching section (760, 660) interacts in a latching manner with a corresponding second latching section (30, 40) of the respective first and second coupling regions (3, 4) in order to provide the mechanical coupling.

6. The lighting strip system (1) according to claim 1, wherein the lighting strip lamp (6) extends completely between the two side walls (21, 22), and covers the carrier profile (2) on the side (23) opposite the base wall (20).

7. The lighting strip system (1) according to claim 1, wherein the functional region (73) extends completely between the two side walls (21, 22), and bears flush and gap-free against the lighting strip lamp (6) in the longitudinal axis direction (L) in order to cover the carrier profile (2) on the side (23) opposite the base wall (20) without gaps.

8. The lighting strip system (1) according to claim 1, wherein the power supply unit (5) is provided between the base wall (20) and the first coupling region (3) and on the base wall (20).

9. The lighting strip system (1) according to claim 1, wherein the first and second electrical contacting elements (67, 77) are constructed identically.

10. The lighting strip system (1) according to claim 9, wherein the first electrical contacting element (67) extends in a first extension direction in a region between the lighting strip lamp (6) and the base wall (20), and projects from the lighting strip lamp (6) into the receiving space (A) as far as the power supply unit (5), and wherein the second electrical contacting element (77) extends in a second extension direction in the region between the lighting strip lamp (6) and the base wall (20), and extends from the operating region (74) in a protruding manner on both sides with respect to this extension direction, and projects at least from the operating region (74) into the receiving space (A) as far as the power supply unit (5).

11. The lighting strip system (1) according to claim 1, wherein the carrier profile (2) has an essentially U-shaped cross-section as viewed in the longitudinal axis direction (L), the base wall (20) and the two side walls (21, 22) of the carrier profile (2) form an essentially U-shaped cross-section as viewed in the longitudinal axis direction (L), wherein the open side (23) of the carrier profile (2) opposite the base wall (20) forms a light emission side via which the lighting strip lamp (6) and the electrical or electronic unit (7) can be inserted into the carrier profile (2) for mechanical coupling with the respective coupling regions (3, 4).

12. The lighting strip system (1) according to claim 1, wherein the lighting strip lamp (6) has, on its side facing the receiving space (A), electronic components, including an operating device (65), which are spaced apart from the opposite end faces (68) of the lighting strip lamp (6) in the longitudinal axis direction (L) and are provided at the center of the lighting strip lamp (6), wherein the lighting strip lamp (6) has the second coupling element (66) in the form of latching springs in the region between at least one of the end faces (68) and said electronic components.

13. The lighting strip system (1) according to claim 1, wherein the electrical or electronic unit (7) has a lamp, a sensor (70), an AC/DC converter (71), a camera module, a WLAN module, a scanner, a projector, a laser projector, monitoring electronics, a data transmission system, a plug adapter (71) for connecting electrical or electronic components (711, 713, 715), wherein the functional region (73) has functional components of the electrical or electronic unit (7), including a lamp having a spotlight head (720) and a spotlight shaft (721), a sensor head (700, 715), USB-C connection sockets (710, 712, 714), a WLAN antenna (713), and a camera head (711), and wherein the operating region (74) has operating components of the electrical or electronic unit (7), including an operating device (740), a lamp controller, a sensor processing unit, and an AC/DC converter unit.

14. The lighting strip system (1) according to claim 1, wherein the carrier profile (2) is formed in several parts in the longitudinal axis direction (L).

15. The lighting strip system (1) according to claim 1, wherein the lighting strip lamp (6) has an LED module, for light emission and an optical unit (63) for influencing the light emitted by the LED module and wherein the lighting strip lamp (6) further has a lighting strip carrier (64) which carries the lamp components, the second coupling element (66), and the first electrical contacting element (67).

16. The lighting strip system (1) according to claim 1, wherein the lighting strip lamp (6) is essentially planar on its outer side (F) facing away from the receiving space (A) and terminates essentially flush with the side (23) of the carrier profile (2) opposite the base wall (20), and/or wherein the functional region (73) is essentially planar on its side (S) facing away from the receiving space (A) and terminates essentially flush with the side (23) of the carrier profile (2) opposite the base wall (20) and further with the planar outer side (F) of the lighting strip lamp (6).

17. The lighting strip system (1) according to claim 1, wherein the first mechanical coupling region (3) and/or the second mechanical coupling region (4) has a plurality of coupling regions in planes spaced differently with respect to the base wall (20).

18. A lighting strip system (1) that extends along a longitudinal axis direction (L), having:

an elongated carrier profile (2) with two elongated side walls (21, 22) that face each other and an elongated base wall (20) connecting the side walls (21, 22), which together delimit a receiving space (A);

a first and a second mechanical coupling region (3, 4), wherein the first coupling region (3) is provided on the side of one of the side walls (21) and the second coupling region (4) is provided on the side of the other of the side walls (22) as viewed in the longitudinal axis direction (L), wherein the first and second coupling regions (3, 4) extend in the longitudinal axis direction (L) in the receiving space (A) over the entire length of the carrier profile (2);

an elongated power supply unit (5) which is located between the two side walls of the elongated carrier profile and extends in the longitudinal axis direction (L) in the receiving space (A);

a lighting strip lamp (6) which extends in the longitudinal axis direction (L) to emit light along an open side of the elongated carrier profile opposite the base wall, is electrically contacted with the power supply unit (5) and is releasably mechanically coupled to the coupling regions (3, 4); and an electrical or electronic unit (7) that is different from the lighting strip lamp and has a functional region (73) and an operating region (74), wherein the functional region (73) is arranged adjacent to the lighting strip lamp (6) in the longitudinal axis direction (L) along the open side of the elongated carrier profile, and wherein the operating region (74) extends starting from the functional region (73) at least partially between the lighting strip lamp (6) and the base wall (20), is electrically contacted with the power supply unit (5) and is releasably mechanically coupled to the coupling regions (3, 4);

wherein the lighting strip lamp (6) has a second coupling element (66) for coupling to the second coupling region (4), and the electrical or electronic unit (7) has a first coupling element (76) for coupling to the first coupling region (3); and further wherein the lighting strip lamp (6) has a first electrical contacting element (67) that makes electrical contact with the elongated power supply and the operating region (74) of the electrical or electronic unit (7) has a second electrical contacting element (77) that makes electrical contact with the elongated power supply.

* * * * *